US010479074B2

(12) United States Patent
Arakane

(10) Patent No.: US 10,479,074 B2
(45) **Date of Patent: *Nov. 19, 2019**

(54) LIQUID DROPLET JETTING APPARATUS

(71) Applicant: BROTHER KOGYO KABUSHIKI KAISHA, Nagoya-shi, Aichi-ken (JP)

(72) Inventor: Satoru Arakane, Nagoya (JP)

(73) Assignee: BROTHER KOGYO KABUSHIKI KAISHA, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/002,013

(22) Filed: Jun. 7, 2018

(65) Prior Publication Data

US 2018/0354261 A1 Dec. 13, 2018

Related U.S. Application Data

(63) Continuation of application No. 15/346,009, filed on Nov. 8, 2016, now Pat. No. 9,994,015.

(30) Foreign Application Priority Data

Nov. 9, 2015 (JP) ..... 2015-219632

(51) Int. Cl.
*B41J 29/38* (2006.01)
*B41J 2/045* (2006.01)
*B41J 2/21* (2006.01)

(52) U.S. Cl.
CPC ..... *B41J 2/04573* (2013.01); *B41J 2/04586* (2013.01); *B41J 2/2132* (2013.01); *B41J 2/2135* (2013.01)

(58) Field of Classification Search
None
See application file for complete search history.

(56) References Cited

U.S. PATENT DOCUMENTS 5,576,744 A 11/1996 Niikura et al.
9,994,015 B2 * 6/2018 Arakane ..... B41J 2/04573
(Continued)

FOREIGN PATENT DOCUMENTS

JP 3293707 B2 6/2002
JP 3313819 B2 8/2002
JP 2008-230069 A 10/2008

OTHER PUBLICATIONS

Office Action dated Aug. 28, 2017 from parent U.S. Appl. No. 15/346,009.
(Continued)

*Primary Examiner* — Matthew Luu
*Assistant Examiner* — Tracey M McMillion
(74) *Attorney, Agent, or Firm* — Scully, Scott, Murphy & Presser, P.C.

(57) ABSTRACT

A liquid droplet jetting apparatus includes: a carriage configured to scan in a main scanning direction; a jetting head installed in the carriage, having nozzles arranged in a sub scanning direction intersecting with the main scanning direction, and configured to jet liquid droplets from the nozzles; a conveyer configured to convey the recording medium in the sub scanning direction; and a controller configured to control the carriage, the jetting head and the conveyer. The nozzles form nozzle groups including two nozzle groups adjacent in the sub scanning direction; and the controller is configured to execute a predetermined printing mode in which a pass printing and conveyance of the recording medium in the sub scanning direction are alternately performed. The pass printing causes the carriage to move one time in the main scanning direction while jetting the liquid droplets from the nozzles.

10 Claims, 11 Drawing Sheets

(56) References Cited

U.S. PATENT DOCUMENTS

| | | | |
|---|---|---|---|
| 2008/0225068 | A1 | 9/2008 | Morino et al. |
| 2011/0175958 | A1 | 7/2011 | Sato et al. |
| 2013/0027457 | A1 | 1/2013 | Yamazaki et al. |

OTHER PUBLICATIONS

Notice of Allowance dated Feb. 15, 2018 from parent U.S. Appl. No. 15/346,009.

* cited by examiner

LIQUID DROPLET JETTING APPARATUS

CROSS REFERENCE TO RELATED APPLICATION

The present application is a continuation application of U.S. Ser. No. 15/346,009 filed on Nov. 8, 2016 and claims priority from Japanese Patent Application No. 2015-219632 filed on Nov. 9, 2015, the disclosure of each which are incorporated herein by reference in their entirety.

BACKGROUND

The present invention relates to a liquid droplet jetting apparatus, particularly to a liquid droplet jetting apparatus provided with a jetting head and configured to perform recording on a recording medium by jetting liquid droplets from nozzles onto the recording medium.

DESCRIPTION OF THE RELATED ART

In an ink-jet printer as an example of the liquid droplet jetting apparatus, a landing position of ink jetted from a nozzle depends on the distance between the nozzle and a recording medium. Therefore, in a case that this distance is varied or changed in a sub scanning direction of the recording medium, any shift in the landing position of the ink occurs among nozzles aligned in the sub scanning direction and between continuous pass printings, which in turn lowers the image quality. In view of this, in an ink-jet recording apparatus described in Japanese Patent Application Laid-open No. 2008-230069, a jetting timing of the ink is corrected depending on the distance between the nozzles and the recording medium to thereby adjust the landing position of the ink (ink landing position).

In this ink-jet recording apparatus, ribs on a platen are divided into two regions that are upstream and downstream regions, along the sub scanning direction of the recording medium; in each of the two regions, the distance between one of the ribs and a recording head is measured, as a gap-from-paper distance, by a gap-from-paper detecting unit. Further, nozzles are also aligned to form two nozzle groups corresponding to the two (upstream and downstream) regions of the ribs, and the jetting timing is corrected for each of the nozzle groups, depending on the gap-from-paper distance measured therefor.

SUMMARY

In the above-described ink-jet recording apparatus, the jetting timing is set per each of the nozzle groups, regardless of the content (detail, feature, etc.) of an image to be printed, and thus there is such a case that the image quality might be lowered for some images. Namely, in the case where the jetting timing is corrected for each of the nozzle groups, any positional shift (deviation) in the ink landing position occurs not only between a pass printing in which the recording head is caused to perform one scanning in the main scanning direction and another (subsequent) pass printing which is performed after causing the recording medium to be conveyed in the sub scanning direction following the pass printing, but occurs also between nozzle groups which are adjacent during a certain pass printing. Due to such a positional shift in the ink landing position, the dots formed at the ink landing positions respectively are shifted in the main scanning direction, resulting in the formation of a boundary (border) in the recorded image. Due to such a boundary, in a case that the jetting timing is corrected for each of the nozzle groups within a pass and that an image formed by a pass printing as a target (target pass printing) and another image adjacent to the image are not connected (continued) in the sub scanning direction, any boundary is unnecessarily formed between the nozzle groups within the pass, resulting in a lowered image quality.

The present teaching has been made to solve the above-described task; an object of the present teaching is to provide a liquid droplet jetting apparatus capable of reducing the lowering in image quality.

According to a first aspect of the present teaching, there is provided a liquid droplet jetting apparatus including:

a carriage configured to scan in a main scanning direction;

a jetting head installed in the carriage, the jetting head having nozzles arranged in a sub scanning direction intersecting with the main scanning direction, the jetting head configured to jet liquid droplets from the nozzles, the nozzles forming nozzle groups including two nozzle groups which are adjacent in the sub scanning direction;

a conveyer configured to convey a recording medium in the sub scanning direction; and a controller configured to control the carriage, the jetting head and the conveyer, wherein in a predetermined printing mode, the controller executes a pass printing and conveyance of the recording medium in the sub scanning direction alternately, the pass printing causing the carriage to move one time in the main scanning direction while jetting the liquid droplets from the nozzles of the jetting head, the predetermined printing mode including a target pass printing, a preceding pass printing which is performed immediately before the target pass printing and a succeeding pass printing which is performed immediately after the target pass printing;

in the predetermined printing mode, the controller executes a jetting timing determining process for determining a jetting timing for each of the nozzle groups based on a printing data, in the jetting timing determining process, the controller determines that a first condition is satisfied in a case that both a first spacing distance and a second spacing distance are not more than a first threshold value, the first spacing distance being a distance between a first target position located on a most downstream side in the sub scanning direction among landing target positions of the liquid droplets in the target pass printing and a second target position located on a most upstream side in the sub scanning direction among landing target positions of the liquid droplets in the preceding pass printing, the second spacing distance being a distance between a third target position located on a most upstream side in the sub scanning direction among the landing target positions of the liquid droplets in the target pass printing and a fourth target position located on a most downstream side in the sub scanning direction among landing target positions of the liquid droplets in the succeeding pass printing, in the jetting timing determining process, the controller determines that a second condition is satisfied in a case that at least one of the first spacing distance and the second spacing distance is greater than the first threshold value, in a case that the first condition is satisfied, the controller determines the jetting timing such that a target value of a shift amount in the main scanning direction, between landing target positions of liquid droplets jetted from one nozzle group of the two nozzle groups and landing target positions of liquid droplets jetted from the other nozzle group of the two nozzle groups, is not less than a second threshold value, and in a case that the second condition is satisfied, the controller determines the jetting timing such that the target value of the shift amount is less than the second threshold value.

In a case that the first and second spacing distances are not more than the first threshold value, the first target position and the second target positions are arranged regularly, without forming any spacing distance greater than the first threshold value, in the sub scanning direction, and the third target position and the fourth target positions are arranged regularly, without forming any spacing distance greater than the first threshold value, in the sub scanning direction. In such a case, the controller determines the jetting timing such that the target value of the shift amount between the adjacent two nozzle groups is not less than the second threshold value. With this, the (intended, suitable or appropriate) positional shift in the target positions for the liquid droplets is allowed to occur between the nozzle groups in the (one) pass printing. It is possible to reduce the positional shift amount of the target positions of the liquid droplets during the continuous pass printings between the nozzle groups, thereby making it possible to prevent any lowering in the image quality which would be otherwise caused by any large positional shift.

On the other hand, in a case that the first spacing distance and/or the second spacing distance are/is greater than the first threshold value, the spacing distance between the first and second target positions and/or the spacing distance between the third and fourth target positions are/is widened greater than the first threshold value, and thus a blank (blank portion) is formed (defined). In such a case, the controller determines the jetting timing such that the target value of the shift amount between the adjacent nozzle groups is less than the second threshold value. With this, any positional shift in the target positions of the liquid droplets does not occur, or is small, between the nozzle groups in the pass printing. Accordingly, any unnecessarily large positional shift does not occur between the nozzle groups, thus making it possible to prevent the lowering in the image quality which would be otherwise caused by such unnecessarily large positional shift.

According to a second aspect of the present teaching, there is provided a liquid droplet jetting apparatus including:

a carriage configured to scan in a main scanning direction;

a jetting head installed in the carriage, the jetting head having nozzles arranged in a sub scanning direction intersecting with the main scanning direction, the jetting head configured to jet liquid droplets from the nozzles, the nozzles forming a downstream-side nozzle group and an upstream-side nozzle group which are adjacent in the sub scanning direction;

a conveyer configured to convey a recording medium in the sub scanning direction; and a controller configured to control the carriage, the jetting head and the conveyer, wherein the controller is configured to perform:

a first pass printing in which a first image is printed on the recording medium by jetting the liquid droplets from the nozzles of the jetting head while moving the carriage one time in the main scanning direction;

a first conveyance in which the recording medium is conveyed in the sub scanning direction by a predetermined distance by the conveyer, immediately after the first pass printing;

a second pass printing in which a second image is printed on the recording medium by jetting the liquid droplets from the nozzles of the jetting head while moving the carriage one time in the main scanning direction, immediately after the first conveyance, the second image including a downstream-side image formed by the liquid droplets jetted from the downstream-side nozzle group and an upstream-side image formed by the liquid droplets jetted from the upstream-side nozzle group;

a second conveyance in which the recording medium is conveyed in the sub scanning direction by the predetermined distance by the conveyer, immediately after the second pass printing; and a third pass printing in which a third image is printed on the recording medium by jetting the liquid droplets from the nozzles of the jetting head while moving the carriage one time in the main scanning direction, immediately after the second conveyance, wherein in a case that both a first spacing distance between the first image and the second image in the sub scanning direction and a second spacing distance between the second image and the third image in the sub scanning direction are not more than a first threshold value, the controller determines jetting timings from the downstream-side nozzle group and the upstream-side nozzle group in the second pass printing such that a shift amount between the downstream-side image and the upstream-side image in the main scanning direction is not less than a second threshold value, and wherein in a case that at least one of the first spacing distance and the second spacing distance is greater than the first threshold value, the controller determines the jetting timings from the downstream-side nozzle group and the upstream-side nozzle group in the second pass printing such that the shift amount between the downstream-side image and the upstream-side image in the main scanning direction is less than the second threshold value.

According to a third aspect of the present teaching, there is provided a liquid droplet jetting apparatus including:

a carriage configured to scan in a main scanning direction;

a jetting head installed in the carriage, the jetting head having nozzles arranged in a sub scanning direction intersecting with the main scanning direction, and the jetting head configured to jet liquid droplets from the nozzles, the nozzles forming nozzle groups including first and second nozzle groups which are adjacent in the sub scanning direction;

a conveyer configured to convey a recording medium in the sub scanning direction; and a controller configured to control the carriage, the jetting head and the conveyer, wherein the controller is configured to execute a predetermined printing mode including a target pass printing, a preceding pass printing which is performed immediately before the target pass printing, and a succeeding pass printing which is performed immediately after the target pass printing, wherein the controller is configured to:

determine whether a first spacing distance and a second spacing distance are not more than a first threshold value, the first spacing distance being a distance between a first target position located on a most downstream side in the sub scanning direction among landing target positions of the liquid droplets in the target pass printing and a second target position located on a most upstream side in the sub scanning direction among landing target positions of the liquid droplets in the preceding pass printing, the second spacing distance being a distance between a third target position located on a most upstream side in the sub scanning direction among the landing target positions of the liquid droplets in the target pass printing and a fourth target position located on a most downstream side in the sub scanning direction among landing target positions of the liquid droplets in the succeeding pass printing, and determine a respective jetting timing for each of the first and second nozzle groups in the target pass printing based on the determination as to the first spacing distance and the second spacing distance.

The above-described object of the present teaching, as well as another object(s) of the present teaching, features of the present teaching and advantage achieved by the present teaching will be apparent from the following detailed explanation of an embodiment of the present teaching, with reference to the attached drawings.

DESCRIPTION OF THE EMBODIMENTS

Figure 1:
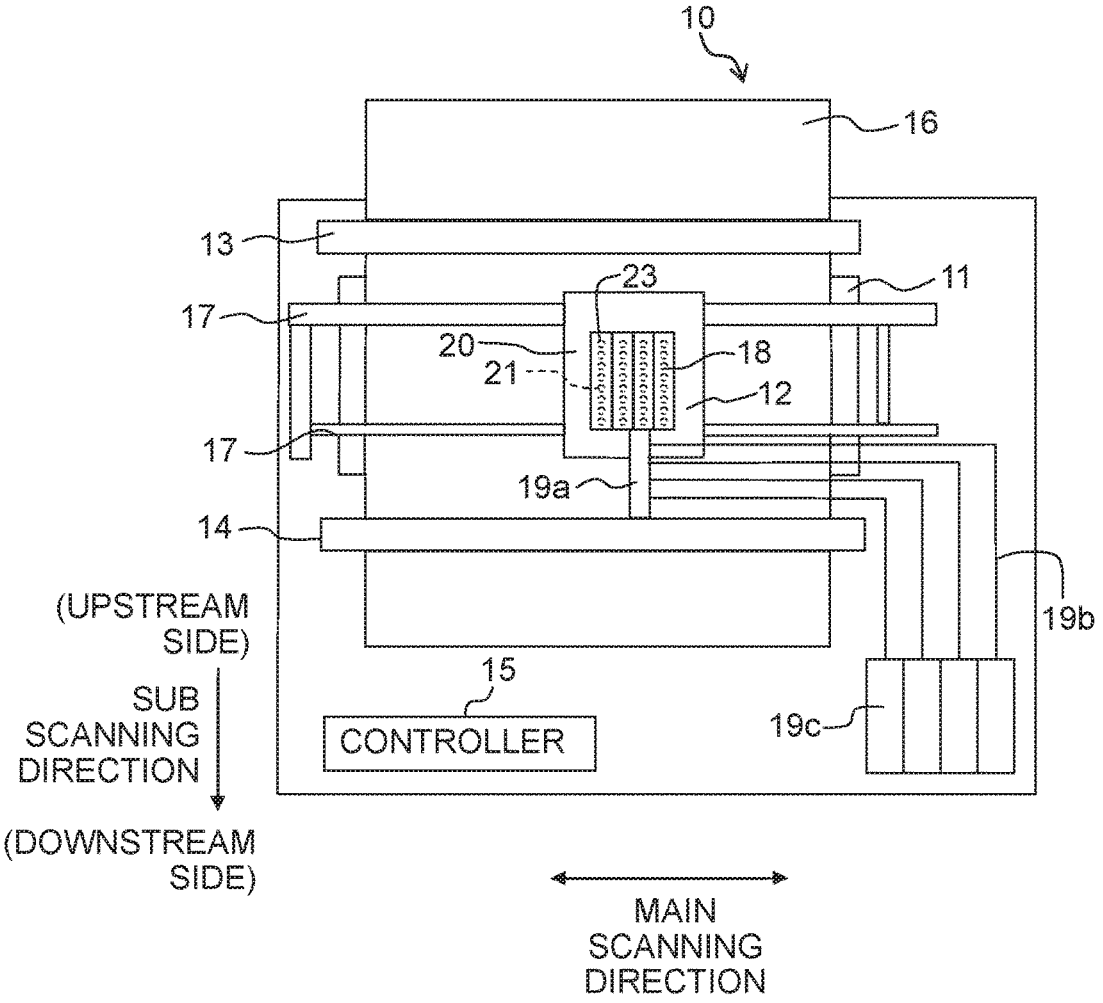
FIG. 1 is a view schematically depicting a liquid droplet jetting apparatus according to a first embodiment of the present teaching.

In the following, an embodiment of the present teaching will be specifically explained with reference to the drawings. Note that in the following explanation, same or similar elements or parts throughout all the drawings are assigned with same or similar reference numerals, and any overlapping explanation therefor will be omitted.

In the embodiment of the present teaching, an explanation will be given about a case in which the present teaching is applied to an ink-jet printer which jets ink from nozzles to perform printing. Note, however, that the present teaching is not limited to this example, and that the present teaching is applicable also to a liquid droplet jetting apparatus which is different from the ink-jet printer and which jets liquid, different from the ink, from nozzles.

First Embodiment

At first, the configuration of a liquid droplet jetting apparatus 10 will be explained with reference to FIG. 1. The liquid droplet jetting apparatus 10 is provided with a jetting head 20, a carriage 12, conveying sections 13 and 14, and a controller 15. The liquid droplet jetting apparatus 10 may be further provided with a paper supplying section (not depicted in the drawings) and a platen 11.

The paper feeding section is a mechanism which supplies a recording medium 16 inside a paper feed tray (not depicted in the drawings) to a conveying path. The platen 11 is a stand on which the supplied recording medium 16 is placed. The recording medium 16 is a paper, etc., on which an image, etc. is formed by liquid droplets jetted from nozzles 21 of the jetting head 20.

The carriage 12 is a member which holds the jetting head 20 and causes the jetting head 20 to reciprocate in a main scanning direction. For example, the carriage 12 is supported by two guide rails 17 extending in the main scanning direction, and reciprocates in the main scanning direction along the guide rails 17. For example, four sub tanks 18 are installed in the carriage 12.

These sub tanks 18 are arranged side-by-side along the main scanning direction, and are connected to a tube joint 19*a*. The sub tanks 18 are connected, via the tube joint 19*a*, to ink cartridges 19*c* by flexible tubes 19*b*, respectively. The four ink cartridges 19*c* store four color inks, respectively, which are for example magenta, cyan, yellow and black inks.

The jetting head 20 is a part causing the liquid droplets to be jetted from the nozzles 21, and is attached to a lower portion of the carriage 12 such that the nozzles 21 face the platen 11 with a spacing distance therebetween. The nozzles 21 are arranged to form nozzle rows 23 each extending in a sub scanning direction intersecting with the main scanning direction. The nozzle rows 23 are arranged in the main scanning direction. It is allowable that the nozzles 21 are not aligned linearly in the sub scanning direction in each of the nozzle rows 23. For example, the nozzles 21 are arranged in a zigzag or staggered manner in each of the nozzle rows 23. Note that the details of the jetting head 20 will be described later on.

The conveying sections 13 and 14 are a mechanism configured to convey the recording medium 16, supplied from the paper feed tray, in the sub scanning direction up to a paper discharge tray (not depicted in the drawings) via a space between the platen 11 and the jetting head 20. As the conveying sections, for example, two conveyance rollers 13 and 14 are used. Among the two conveyance rollers 13 and 14, one conveyance roller (upstream-side conveyance roller) 13 is arranged on the upstream side of the platen 11, and the other conveyance roller (downstream-side conveyance roller) 14 is arranged on the downstream side of the platen 11. Each of the upstream-side and downstream-side conveyance rollers 13 and 14 is rotated in the sub scanning direction with the main scanning direction as the axial direction thereof.

The controller 15 has a calculating section (not depicted in the drawings) and a storing section. The calculating section is constructed of a processor such as a CPU, and the storing section is constructed of a memory which can be accessed by the calculating section. The respective sections of the liquid droplet jetting apparatus 10 such as the carriage 12, the jetting head 20 and the conveying sections 13 and 14, etc. are controlled in a case that programs stored in the storing section are executed by the calculating section. The details of this control will be described later on.

Next, the jetting head 20 will be explained with reference to FIG. 2. For example, the jetting head 20 is provided with the nozzles 21 and head drivers 26 and 27. An opening of one end of each of the nozzles 21 is provided, as a nozzle hole, in the nozzle surface 22, and an opening of the other end of each of the nozzles 21 is connected to a liquid supplying section such as one of the sub tanks 18. Liquid such as ink flows from the liquid supply section and through the nozzles 21, and is jetted from the nozzle holes.

In this embodiment, the nozzles 21 are provided to form thirteen pieces of the nozzle row 23; the thirteen nozzle rows 23 are arranged in the main scanning direction to be parallel to one another. The nozzles 21 in each of the nozzle rows 23 are divided into a plurality of groups in the sub scanning direction. Each of the groups (nozzle groups) includes a plurality of nozzles 21 aligned in the sub scanning direction. In the embodiment, the nozzles 21 in each of the nozzle groups is equally divided into two groups. One group 24 (upstream-side nozzle group 24) of the two groups includes nozzles 21 disposed in an upstream region in the sub scanning direction, and the other group 25 (downstream-side nozzle group 25) of the two groups includes nozzles 21 disposed in a downstream region in the sub scanning direction.

The head drivers 26 and 27 are mounted on a wiring board 20*a*, and are connected to the controller 15 and jetting members via wires of the circuit board 20*a*. An example of the jetting members includes members allowing liquid droplets to be jetted from the nozzles 21 such as, for example, piezoelectric elements 28 each of which is deformable by a voltage applied thereto and which imparts pressure to liquid inside one of the nozzles 21. The head drivers 26 and 27 are made to correspond to the upstream-side and downstream-side nozzle groups 24 and 25, respectively. In the embodiment, two head drivers 26 and 27 are disposed in the jetting head 20. Among the two head drivers 26 and 27, one head driver 26 (upstream-side head driver 26) is connected to the jetting members of the upstream-side nozzle group 24, and the other head driver 27 (downstream-side head driver 27) is connected to the jetting members of the downstream-side nozzle group 25. Accordingly, a jetting amount and a jetting timing of the liquid droplets in the upstream-side nozzle group 24 are controlled by the upstream-side head driver 26, and a jetting amount and a jetting timing of the liquid droplets in the downstream-side nozzle group 25 are controlled by the downstream-side head driver 27.

Figure 3:
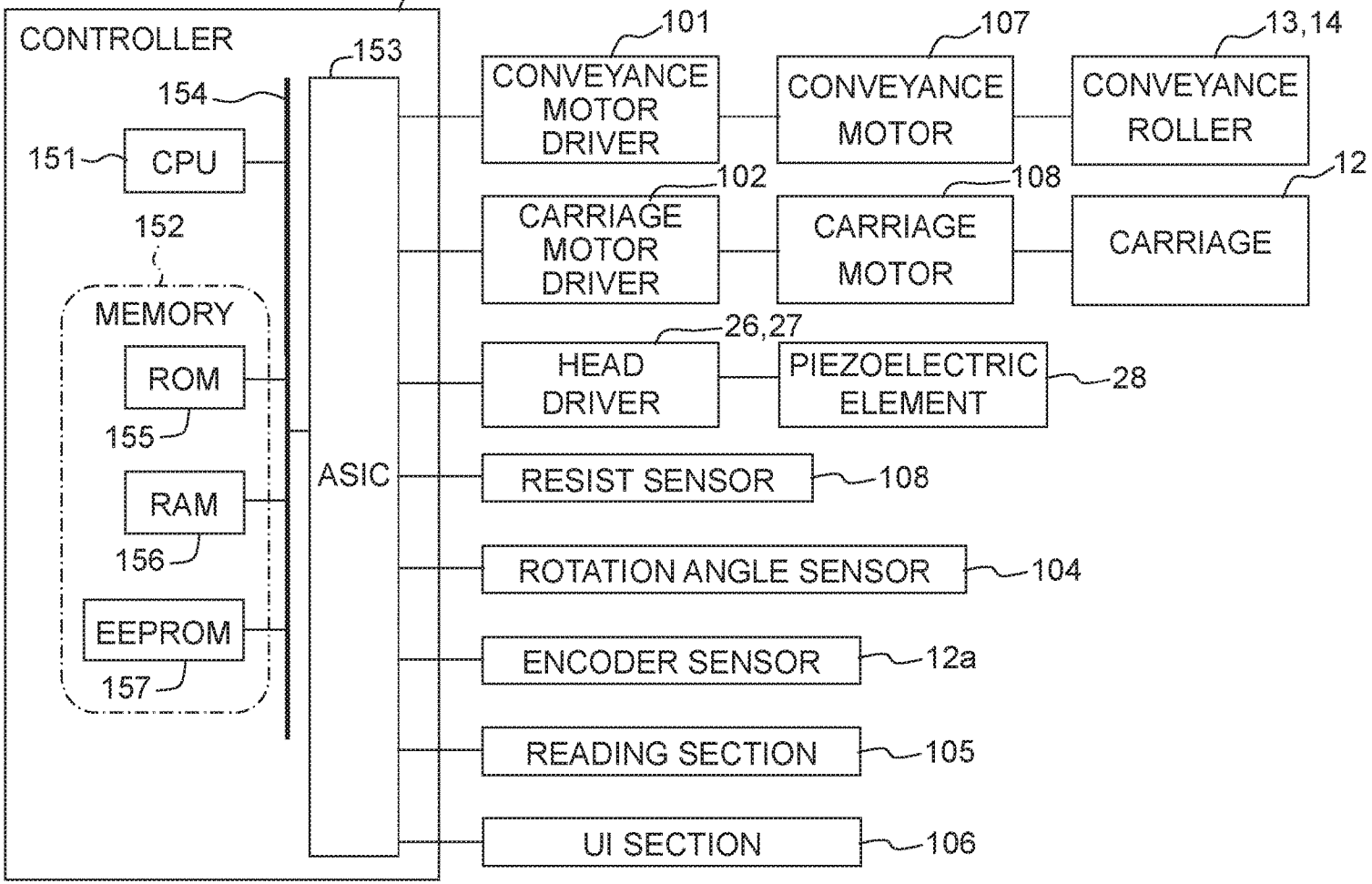
FIG. 3 is a block diagram schematically depicting the configuration of a controller.

Next, the controller 15 will be explained with reference to FIG. 3. The controller 15 has a CPU 151, a memory 152, an ASIC 153 and an internal bas 154 connecting the CPU 151, the memory 152, the ASIC 153 with one another.

The memory 152 includes a ROM 155, a RAM 156 and an EEPROM 157. The ROM 155 stores various programs which are executed by the CPU 151. For example, a program for a jetting timing determining process is stored in the ROM 155. Further, the RAM 156 is used as a storage area for temporarily storing a data and/or signal to be used when the CPU 151 executes a program. The EEPROM 157 stores a setting, flag and/or data which should be stored even after the power source of the liquid droplet jetting apparatus 10 is switched off.

The ASIC 153 is connected to respective drivers that are a conveyance motor driver 101, a carriage motor driver 102, head drivers 26 and 27; respective sensors that are a resist sensor 103, a rotation angle sensor 104, and an encoder sensor 12*a*; a reading section 105; and a user interface section (UI section) 106. The conveyance motor driver 101 drives a conveyance motor 107 to thereby rotate the conveyance rollers 13 and 14. The carriage motor driver 102 drives a carriage motor 108 to thereby move the carriage 12 and the jetting head 20 held by the carriage 12 in the main scanning direction. The head drivers 26 and 27 drive the jetting members such as the piezoelectric elements 28, and allow the piezoelectric elements 28 to cause the liquid droplets to be jetted from the nozzles 21.

Signals are inputted to the ASIC 153 from the respective sensors 103, 104 and 12*a*, the reading section 105 and the UI section 106. The resist sensor 103 detects whether or not a tip (forward end) portion of the recording medium 16 has reached the conveyance roller 13 or 14. The rotation angle sensor 104 detects the rotation angle of each of the conveyance rollers 13 and 14. The encoder sensor 12*a* is a reflection-type optical sensor mounted on the carriage 12, and detects a reflected light from the recording medium 16. The reading section 105 is, for example, an image scanner which reads an image, etc., recorded on the recording medium 16. The UI section 106 is an input section via which a user inputs a command, a request, a job or information. For example, the UI section 106 is a touch panel, a button, a switch, a keyboard, a mouse, etc., attached to the casing of the liquid droplet jetting apparatus 10.

In a case that the controller 15 receives and accepts a print job inputted from an external device (not depicted in the drawings) which is connected to the liquid droplet jetting apparatus 10, the controller 15 outputs a command for executing the print job to the ASIC 153, based on a program stored in the ROM 155. The ASIC 153 drives the respective drivers 101, 102, 26 and 27 to thereby execute a printing process (based on the print job), while monitoring a signal from each of the respective sensors, etc. Note that the print job includes various kinds of information required for the printing process, such as information regarding an image to be recorded on the recording medium 16, an information regarding the properties of the recording medium 16 (information indicating the size of the recording medium 16, and/or whether or not the recording medium 16 is plain paper or glossy paper, etc.). Further, an example of the external device connected to the liquid droplet jetting apparatus 10 includes, for example, a computer such as PC, a device for obtaining an image such as a scanner, a camera, etc., a recording medium such as a USB memory, and the like.

In this embodiment, although the controller 15 is provided only one piece of the CPU 151 which collectively performs the respective kinds of the processing, it is allowable that the controller 15 is provided with a plurality of CPUs and that these CPUs perform the respective kinds of the processing in a sharing manner. Furthermore, in the embodiment, although the controller 15 is provided with only one piece of the ASIC 153 which collectively performs the respective kinds of the processing, it is allowable that the controller 15 is provided with a plurality of pieces of the ASICs 153 and that these ASICs 153 may execute the respective kinds of the processing in a shared manner Next, the printing operation of the liquid droplet jetting apparatus 10 will be explained with reference to FIGS. 1 to 4. The operation is executed by the controller 15. Note that although a case of using the piezoelectric elements 28 as the jetting members will be explained here, the explanation will be similarly applicable also to a case using a jetting member or members different from the piezoelectric elements 28.

The printing mode of the liquid jetting apparatus 10 includes a predetermined printing mode. In the predetermined printing mode, the controller 15 generates a control signal controlling the respective sections, from a printing data for performing printing on the recording medium 16. With this, the recording medium 16 is supplied from the paper feed tray and then is place on a platen 11 by a paper feeding mechanism. Then, a pass printing by the nozzles 21 and the carriage 12 and a conveyance by the conveying sections 13 and 14 are repeated alternately.

In the pass printing, the controller 15 outputs a control signal to each of the upstream-side head driver 26 and the downstream-side head driver 27 of the jetting head 20. This control signal includes voltage applied to the piezoelectric elements 28 and defining the jetting amount of the liquid droplets, and a driving timing at which the piezoelectric elements 28 are driven and which defines the jetting timing of the liquid droplets. Further, the upstream-side head driver 26 drives the piezoelectric elements 28 of the upstream-side nozzle group 24 based on the control signal, and the downstream-side head driver 27 drives the piezoelectric elements 28 of the downstream-side nozzle group 25 based on the control signal. With this, the liquid droplets are jetted from the respective nozzles 21 of the upstream-side nozzle group 24 and from the respective nozzles 21 of the downstream-side nozzle group 25, and land on target positions in the recording medium 16, thereby forming dots at the landing positions of the liquid droplets, respectively.

Figure 4:
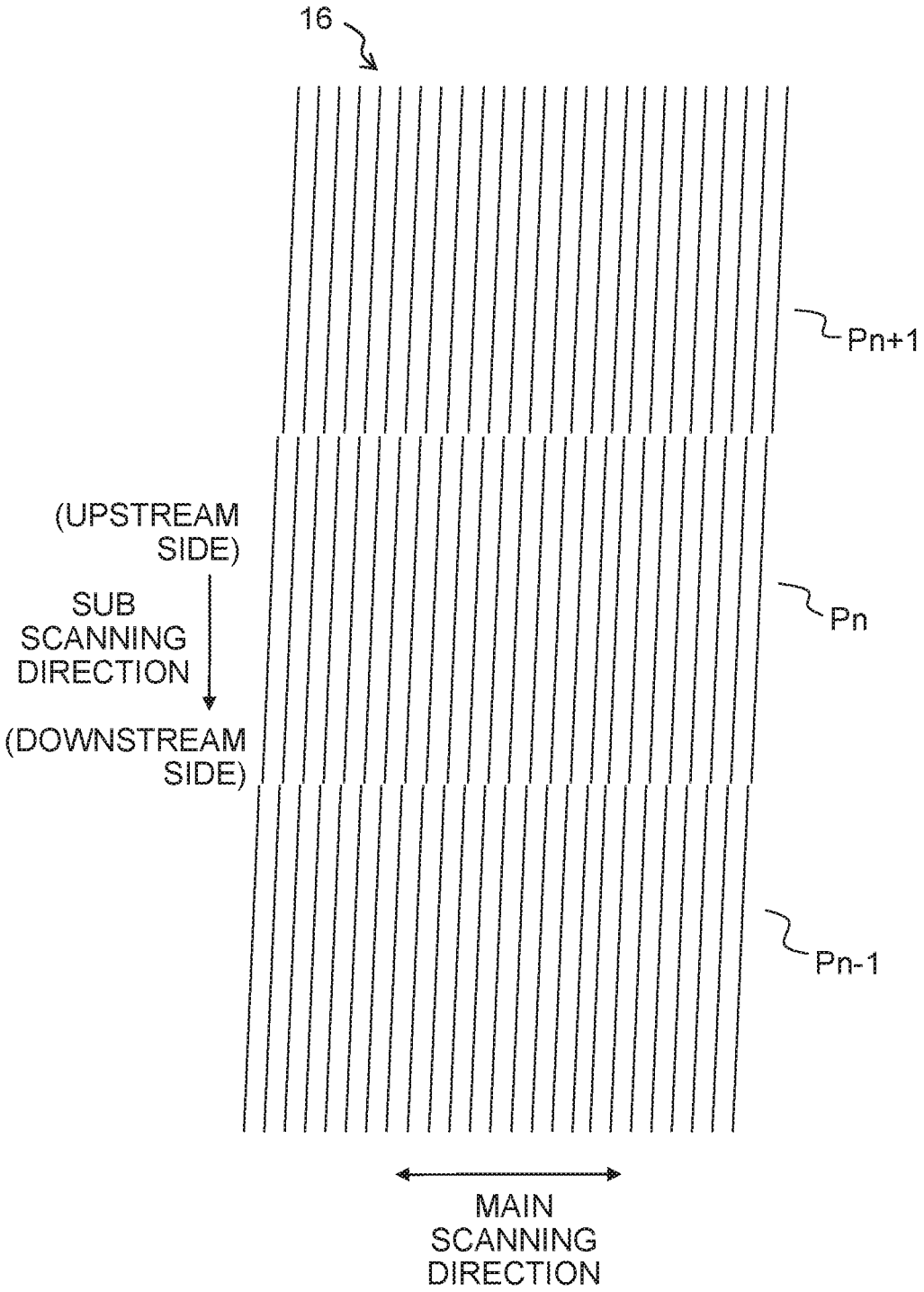
FIG. 4 is a view depicting an example of an image formed in a recording medium.

While executing the above-described processing, the controller 15 outputs a control signal to the carriage 12 depicted in FIG. 1 to cause the carriage 12 to perform one time movement in the main scanning direction. With this, the nozzles 21 of the jetting head 20 are moved in the main scanning direction and the landing positions of the liquid droplets are displaced in the main scanning direction, thereby allowing the dots to be arranged in the main scanning direction to form an image by the pass printing as depicted in FIG. 4. Note that one time of the movement may be a one-directional movement only in a going-path direction or only in a returning-path direction in the main scanning direction, or may be two-directional reciprocating movement in the two (going-path and returning path) directions in the main scanning direction. In the one-directional movement, a one-directional printing is performed in which the liquid droplets are jetted during the movement of the carriage 12 in one of the going-path direction and the returning-path direction, whereas the liquid droplets are not jetted during the movement of the carriage 12 in the other of the going-path direction and the returning-path direction. In the two-directional (reciprocating) movement, two-directional printing is performed in which the liquid droplets are jetted during both of the movement of the carriage 12 in the going-path direction and the movement of the carriage 12 in the returning-path direction.

Further, every time the pass printing is completed, the controller 15 outputs a control signal to the conveying sections 13 and 14 to thereby convey the recording medium 16 in the sub scanning direction by a predetermined amount. The predetermined amount corresponds to the length of each of the nozzle rows 23 in the sub scanning direction. Accordingly, an image Pn formed by a certain pass printing is continued to an image Pn−1 formed by a preceding pass printing which is executed immediately before the certain pass printing. Then, by repeating the pass printing and the conveyance, the image Pn formed by the certain pass printing is continued with an image Pn+1 formed by a succeeding pass printing which is to be executed immediately after the certain pass printing, and further continued with an image formed by another pass printing, thereby forming an entire image on the recording medium 16, as depicted in FIG. 4. Here, the image is such an image in which a plurality of straight lines extending in the sub scanning direction is arranged parallel to one another, with a spacing distance intervened therebetween, in the main scanning direction.

Note that the predetermined amount by which the recording medium 16 is conveyed in the sub scanning direction may be shorter than the length of each of the nozzle rows 23 in the sub scanning direction. In such a case, the image Pn formed by the target pass printing is overlapped slightly in the sub scanning direction with the image Pn−1 formed by the preceding pass printing. Even in this case, the jetting timing determining process can be performed, as will be described later on.

Data regarding the preceding pass printing, data regarding the conveying distance of the recording medium 16, data regarding the target pass printing, the data regarding the conveying distance of the recording medium 16, and data regarding the succeeding pass printing are inputted in this order to the controller 15. Accordingly, the preceding pass printing, the conveyance of the recording medium 16, the target pass printing, the conveyance of the recording medium 16, and the succeeding pass printing are executed continuously in this order.

Next, the jetting timing determining process for determining, for each of the nozzle groups 24 and 25 adjacent to each other, the timing at which the liquid droplets are jetted from the respective nozzles 21 will be explained with reference to FIGS. 4 to 8. The jetting timing determining process is controlled by the controller 15.

Figure 5:
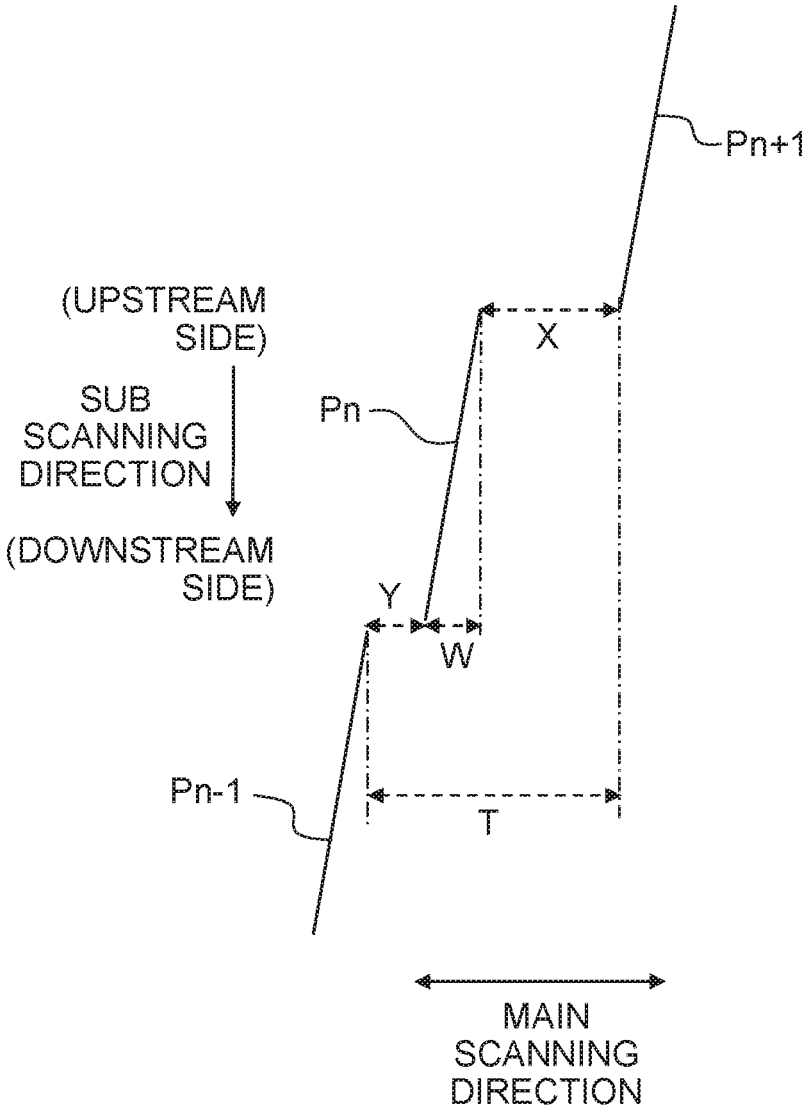
FIG. 5 is an enlarged view depicting one straight line, as depicted in FIG. 4, which extends in a sub scanning direction.
Figure 6:
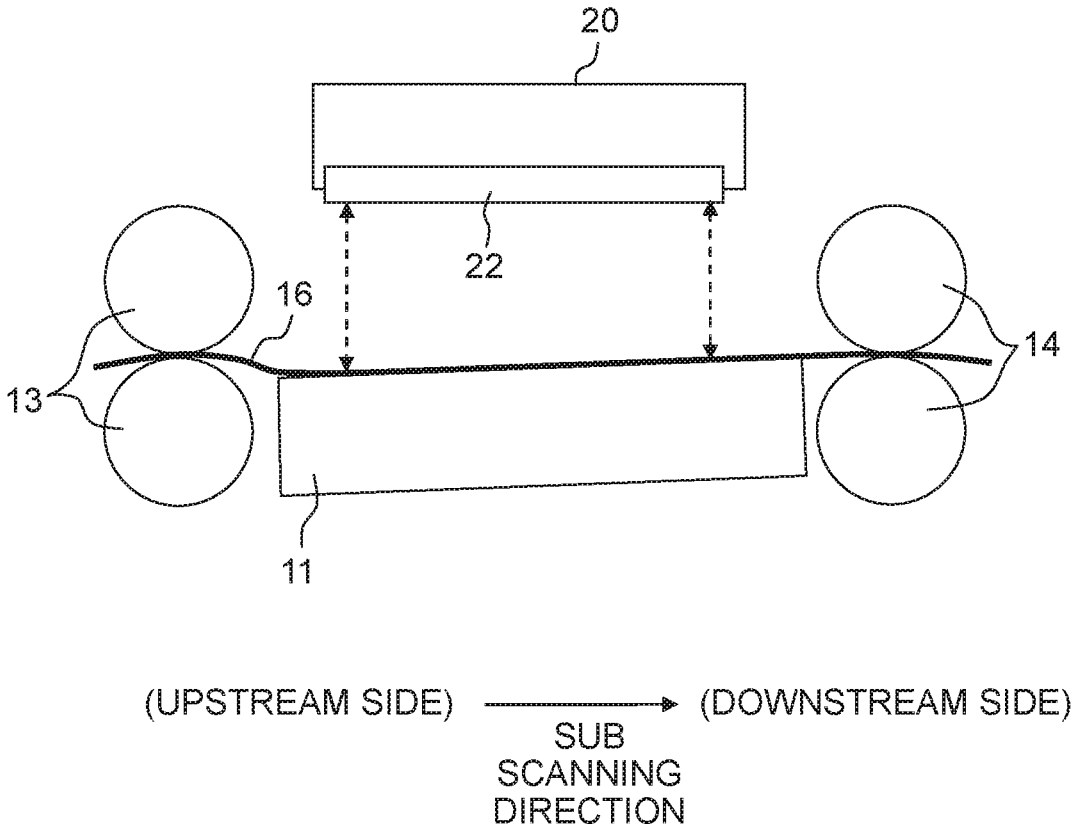
FIG. 6 is a view schematically depicting a recording medium, a jetting head, an upstream-side conveyance roller and a downstream-side conveyance roller.

At first, positional shift of the target positions of the liquid droplets will be explained. The target positions of the liquid droplets depend on the jetting timing of the liquid droplets, the jetting velocity of the liquid droplets, the distance between the nozzle surface 22 and the recording medium 16, the moving velocity of the jetting head 20, etc. For example, the platen 11 is inclined and/or deformed in the sub scanning direction due to, for example, the accuracy of dimension of the platen 11, the accuracy of attachment of the platen 11, or the aged deterioration of the platen 11, in some cases. In a case that there is such an inclination and/or deformation of the platen 11, the recording medium 16 on the platen 11 also is inclined or warped (bent) in the sub scanning direction. In this case, the distance between the upstream-side nozzle group 24 and the recording medium 16 is different from the distance between the downstream-side nozzle group 25 and the recording medium 16. For example, in an example depicted in FIG. 6, the distance between the upstream-side nozzle group 24 and the recording medium 16 is greater than the distance between the downstream-side nozzle group 25 and the recording medium 16. Due to this difference, as depicted in FIG. 5, positional shift (positional shift within the pass printing) W occurs, in the pass printing between upstream-side target positions of the liquid droplets and downstream-side target positions of the liquid droplets.

Further, the jetting head 20 returns to a predetermined start position in the main scanning direction every time the jetting head 20 performs the pass printing, and then the jetting head 20 moves form the predetermined start position in the main scanning direction. It is difficult, however, to make the position of the jetting head 20 be coincident completely with the start position, and the position of the jetting head 20 is shifted or deviated from the start position, in some cases. In such a case, as depicted in FIGS. 4 and 5, positional shift occurs in the main scanning direction (positional shift between the pass printings) between target positions of the liquid droplets formed in a downstream end by the target pass printing (downstream-end position of the image Pn) and target positions of the liquid droplets formed in an upstream end by the preceding pass printing (upstream-end position of the image Pn−1). Such a positional shift between the pass printings depends on the positional shift of the jetting head 20 in the main scanning direction and the positional shift W within the pass printing, etc.

Figure 7:
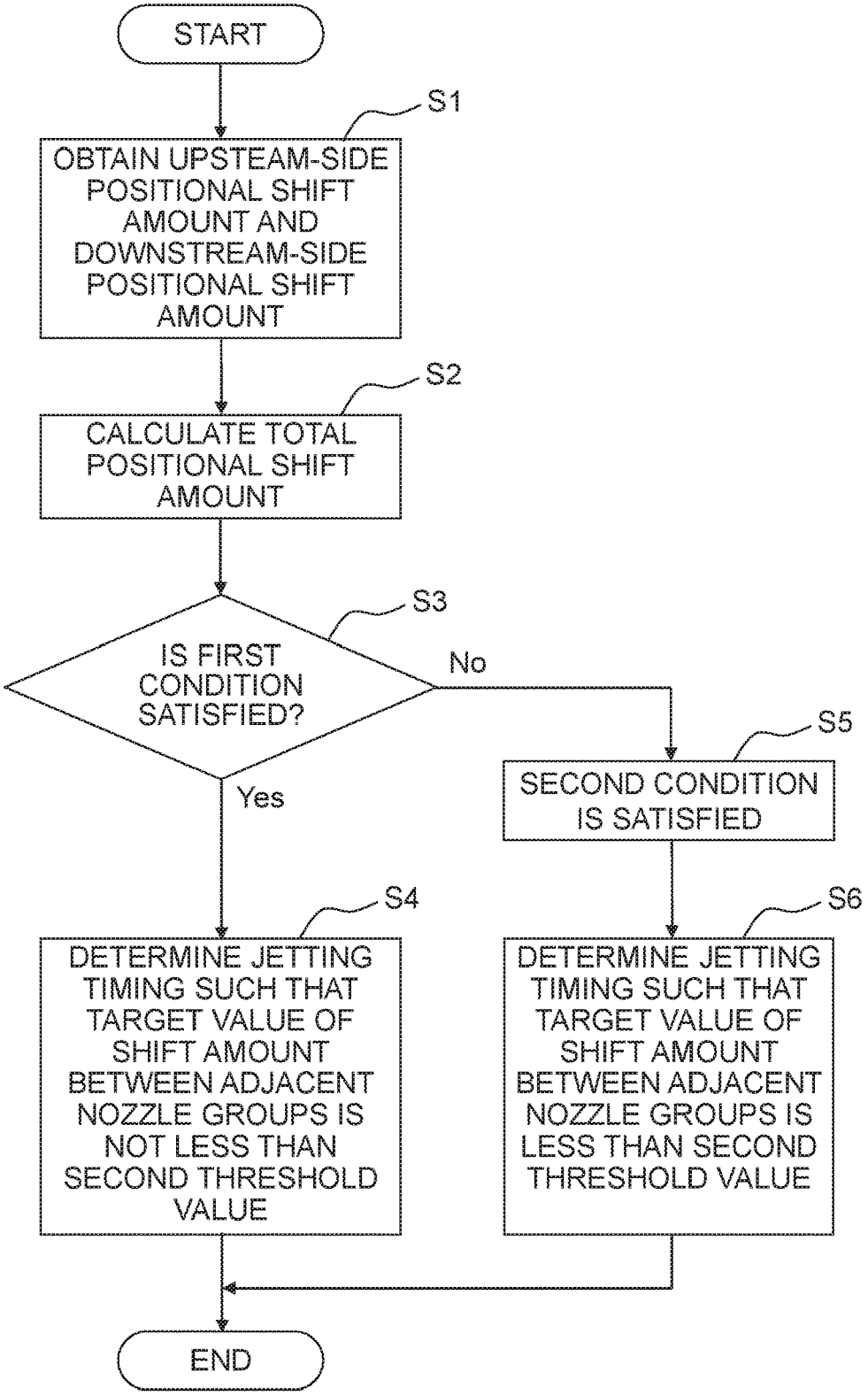
FIG. 7 is a flowchart indicating a jetting timing determining process.

In order to prevent such a lowering in the image quality due to the positional shift between the pass printings, the jetting timing determining process as depicted in FIG. 7 is executed. In the jetting timing determining process, the jetting timing of the liquid droplets is set for each of the nozzle groups 24 and 25, depending on a first condition and a second condition. The jetting timing is determined by advancing (quickening) or delaying a reference jetting timing so as to correct the reference jetting timing. The reference jetting timing is previously determined, for example, based on the position of the jetting head 20 in the main scanning direction, the distance between the nozzle surface 22 and the recording medium 16, and the moving velocity of the jetting head 20, etc.

Specifically, the controller 15 obtains an upstream-side positional shift amount X and a downstream-side positional shift amount Y each of which is the positional shift amount between the pass printings (step S1). The upstream-side positional shift amount X and the downstream-side positional shift amount Y are calculated from the respective printing data which are those used in the target pass printing, the preceding pass printing and the succeeding pass printing. For example, the upstream-side positional shift amount X and the downstream-side positional shift amount Y may be previously obtained by the following manner: namely, an image printed by the liquid droplet jetting apparatus 10 is read with the reading section 105, etc., and the upstream-side positional shift amount X and the downstream-side positional shift amount Y are obtained previously from the positional shift of the printed image. Alternatively, the upstream-side positional shift amount X and the downstream-side positional shift amount Y may be previously obtained by the following manner: namely, the distance between the recording medium 16 and the nozzle surface 22 is obtained with, for example, a distance-measuring sensor, when the liquid droplet jetting apparatus 10 is produced, and the upstream-side positional shift amount X and the downstream-side positional shift Y are obtained from this distance.

The upstream-side positional shift amount X is a shift amount in the main scanning direction between an upstream-most target position on a most upstream side in the sub scanning direction among target positions (namely, landing target positions of the liquid droplets jetted from the nozzles 21 on the recording medium 16) in the target pass printing, and a downstream-most target position on a most downstream side in the sub scanning direction among target positions in the succeeding pass printing. In the example depicted in FIG. 5, the upstream-side positional shift amount X is a distance in the main scanning direction between a dot in an upstream end in the main scanning direction of an image Pn formed by the target pass printing and a dot in a downstream end in the sub scanning direction of an image Pn+1 formed by the succeeding pass printing.

The downstream-side positional shift amount Y is a shift amount in the main scanning direction between a downstream-most target position on the most downstream side in the sub scanning direction among the target positions in the target pass printing, and an upstream-most target position on the most upstream side in the sub scanning direction among target positions in the preceding pass printing. In the example depicted in FIG. 5, the downstream-side positional shift amount Y is a distance in the main scanning direction between a dot in a downstream end in the sub scanning direction of the image Pn formed by the target pass printing and a dot in an upstream end in the sub scanning direction of an image Pn−1 formed by the preceding pass printing.

The controller 15 calculates a total positional shift amount T which is the sum of the upstream-side positional shift amount X and the downstream-side positional shift amount Y (step S2). For example, in a case that the upstream-side positional shift amount X is 70 μm and the downstream-side positional shift amount Y is 50 μm, the total positional shift amount T is 120 μm.

Further, the controller 15 determines whether or not the first condition is satisfied (step S3). The first condition is a condition in which each of a first spacing distance and a second spacing distance is not more than a first threshold value. The first spacing distance is a distance in the sub scanning direction between a first target position and a second target position; and the second spacing distance is a distance in the sub scanning direction between a third target position and a fourth target position. The first target position is the downstream-most target position on the most downstream side in the sub scanning direction among the target positions in the target pass printing, and the second target position is the upstream-most target position on the most upstream side in the sub scanning direction among the target positions in the preceding pass printing. The third target position is the upstream-most target position on the most upstream side in the sub scanning direction among the target positions in the target pass printing, and the fourth target position is the downstream-most target position on the most downstream side in the sub scanning direction among the target positions in the succeeding pass printing. The first threshold value is a spacing distance between adjacent target positions of the liquid droplets in a case that target positions of the liquid droplets are aligned in the sub scanning direction. The first threshold value is, for example, a spacing distance in the sub scanning direction between dots which are formed by liquid droplets jetted from adjacent nozzles within a nozzle group, or the length of one (1) dot in the sub scanning direction.

For example, the controller 15 determines whether or not the first condition is satisfied, based on a value regarding the conveying distance of the recording medium 16 (step S3). Namely, in a case that each of a first distance value and a second distance value is not more than a third threshold value, the controller 15 determines that the first condition is satisfied (step S3: YES). The first distance value is a value indicating a distance (conveying distance) by which the recording medium 16 is conveyed in the sub scanning direction between the preceding pass printing and the target pass printing. The second distance value is a value indicating a distance (conveying distance) by which the recording medium 16 is conveyed in the sub scanning direction between the target preceding pass printing and the succeeding pass printing. An example of the value indicating the conveying distance includes, for example, an actual conveying distance, a level in a case that the conveying distance is classified into the levels, etc. The value indicating the conveying distance may be a value stored in the memory 152 (see FIG. 3) of the liquid droplet jetting apparatus 10, may be a value inputted from the printer driver of a camera, computer, etc., to the liquid droplet jetting apparatus 10, or may be a value obtained in the liquid droplet jetting apparatus 10 based on an inputted data.

The controller 15 obtains the first distance value and the second distance value based on the printing data. For example, the controller 15 obtains the first and second distance values based on respective printing data which are the printing data regarding the target pass printing and the printing data regarding the preceding pass printing and the succeeding pass printing, or based on a printing data regarding the conveyance between continued pass printings, etc. Further, the controller 15 determines that the first condition is satisfied in a case that each of the first distance value and the second distance value is not more than the third threshold value (step S3: YES).

Normally, the conveying sections 13 and 14 convey the recording medium 16 only by a distance corresponding to the length of the nozzle row 23 in the sub scanning direction (the length in the sub scanning direction of an image formed by a pass printing). With this, the first target position and the second target position are regularly arranged side by side at a spacing distance not more than the first threshold value, and the image Pn formed by the target pass printing and the image Pn−1 formed by the preceding pass printing are joined to each other in the sub scanning direction. Further, the third target position and the fourth target position are arranged regularly side by side in the sub scanning direction at a spacing distance not more than the first threshold value, and the image Pn formed by the target pass printing and the image Pn+1 formed by the succeeding pass printing are joined to each other in the sub scanning direction. Accordingly, the third threshold value corresponds, for example, to the length in the sub scanning direction of the nozzle row 23. Note, however, that in a case that the printing is performed such that the images formed by the respective pass printings are slightly overlapped in the sub scanning direction, the third threshold value is set to be shorter than the length in the sub scanning direction of the nozzle row 23.

In a case that the first condition is satisfied (step S3: YES), the controller 15 determines the jetting timing such that a target value of a shift amount between the adjacent nozzle groups is not less than a second threshold value (step S4). The target value of the shift amount between the adjacent nozzle groups is a target value of a shift amount in the main scanning direction between target positions of liquid droplets jetted from one nozzle group among the adjacent nozzle groups 24 and 25 and target positions of liquid droplets jetted from the other nozzle group among the adjacent nozzle groups 24 and 25. Further, the second threshold value is the minimum or smallest unit of the shift amount of the jetting timing that the liquid jetting head 20 is capable of setting (for example, in a case that the jetting timing can be shifted at 48 MHz, the second threshold value is a value corresponding to 1/48 MHz).

For example, the controller 15 divides the total positional shift amount T equally by a number obtained by adding 1 (one) to a total number of the nozzle groups 24 and 25. Further, the controller 15 sets the jetting timing for each of the nozzle groups 24 and 25 such that the equally divided value becomes a target value Z of the shift amount between the adjacent nozzle groups 24 and 25 in the target pass printing, a target value X' of the upstream-side positional shift amount, and a target value Y' of the downstream-side positional shift amount (step S4).

Figure 2:
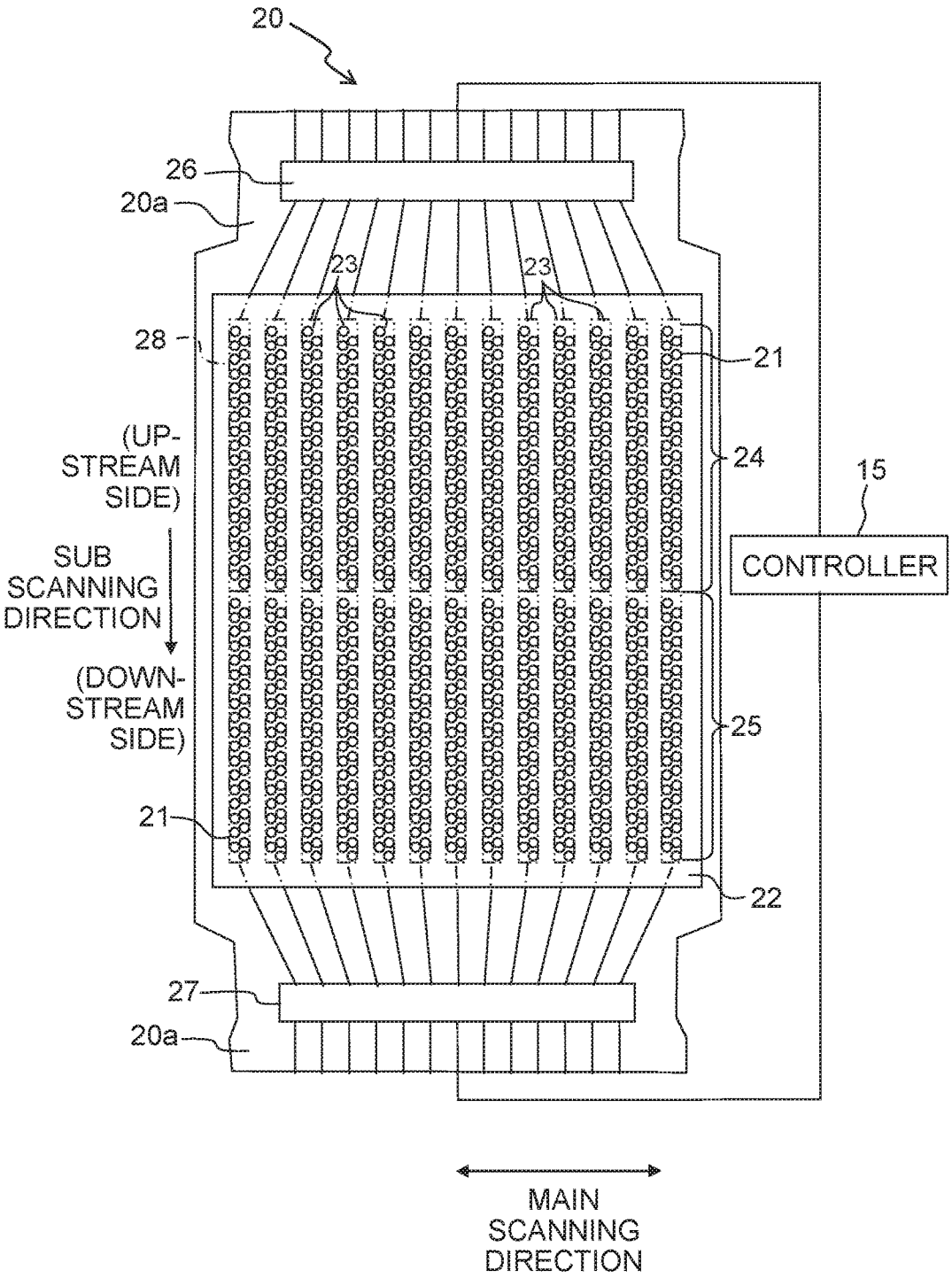
FIG. 2 is a view schematically depicting a jetting head as seen from a side of a nozzle surface.
Figure 8:
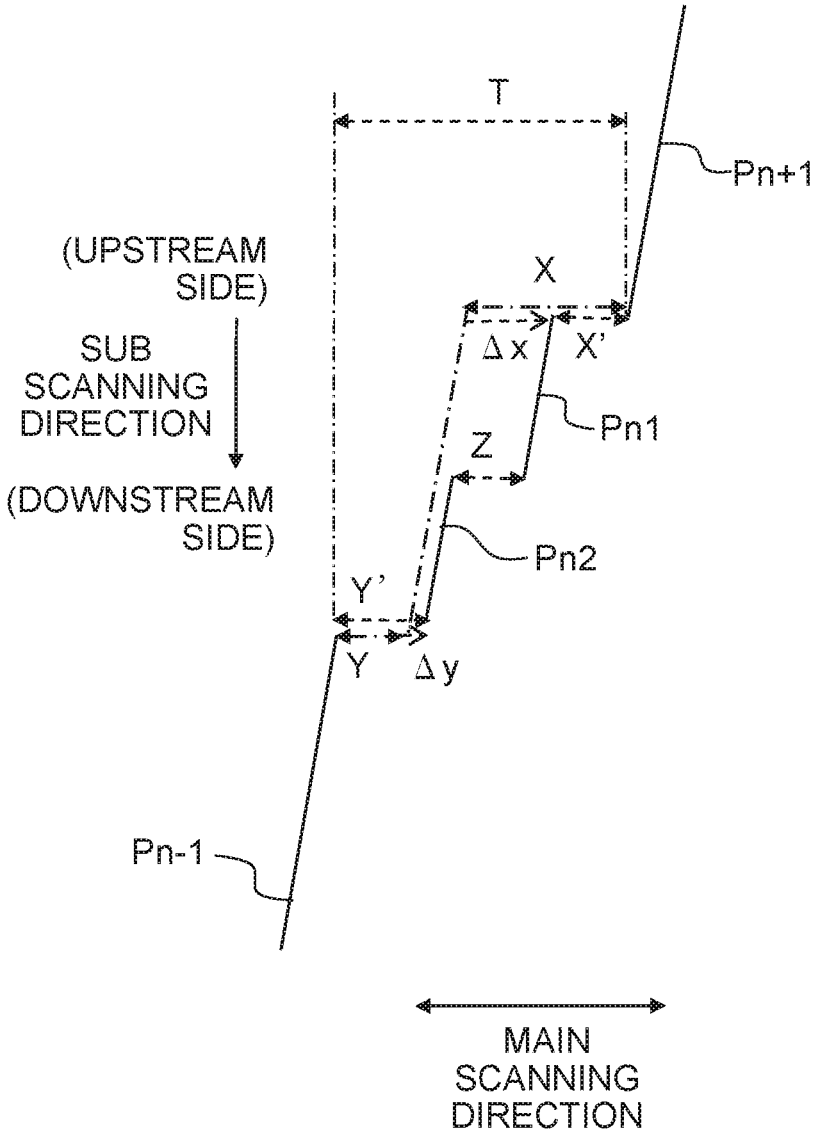
FIG. 8 is a view depicting an example of an image in a case that the jetting timing is determined such that a target value of a shift amount between adjacent nozzle groups becomes not less than a second threshold value.

In this embodiment, the number of the nozzle groups 24 and 25 is 2 (two) as depicted in FIGS. 2 and 8 and the total positional shift amount T is 120 μm. In this case, each of the target values Z, X' and Y' of the positional shift amounts is calculated as follows: 120 μm/(2+1)=40 μm. Accordingly, the controller 15 sets the jetting timing for each of the upstream-side nozzle group 24 and the downstream-side nozzle group 25 such that each of the target value Z of the shift amount between the adjacent nozzle groups 24 and 25 in the target pass printing, the target value X' of the upstream-side positional shift amount and the target value Y' of the downstream-side positional shift amount becomes 40 μm.

Here, while the target value X' of the upstream-side positional shift amount is 40 μm, the upstream-side positional shift amount X is 70 μm. Accordingly, a dot displacement amount of the dot at the upstream end in the target pass printing (displacement amount Δx at the upstream-side position) is 30 μm. A correcting amount of the jetting timing, corresponding to this displacement amount Δx, for the upstream-side nozzle group 24 is determined. Then, the reference jetting timing is corrected by the obtained correction amount so as to determine the jetting timing for the upstream-side nozzle group 24.

Further, while the target value Y' of the downstream-side positional shift amount is 40 μm, the downstream-side positional shift amount Y is 50 μm. Accordingly, a dot displacement amount of the dot at the downstream end in the target pass printing (displacement amount Δy at the downstream-side position) is 10 μm. A correcting amount of the jetting timing, corresponding to this displacement amount Δy, for the downstream-side nozzle group 25 is determined. Then, the reference jetting timing is corrected by the obtained correction amount so as to determine the jetting timing for the downstream-side nozzle group 25.

In such a manner, the correction amounts of the jetting timings for the respective nozzle groups 24 and 25 are set to be different values, respectively. Note that the relationship between the displacement amount Δx at the upstream-side position and the displacement amount Δy at the downstream-side position and the correction amounts of the jetting timings is previously obtained by an experiment or a simulation, etc.

On the other hand, the controller 15 determines that the first condition is not satisfied in a case that the first distance value and/or the second distance value are/is greater than the third threshold value (step S3: NO). In such a case, the controller 15 determines that the second condition is satisfied (step S5). The second condition is such a condition that the first spacing distance and/or the second spacing distance are/is greater than the first threshold value. For example, in a case that the spacing distance between the first and second target positions and/or the spacing distance between the third and fourth target positions are/is greater than the first threshold value, a blank portion is formed in a region corresponding to at least one of the above-described spacing distances, rather than forming any dot. Accordingly, the image Pn formed by the target pass printing is not joined in the sub scanning direction with the image Pn−1 formed by the preceding pass printing and/or the image Pn+1 formed by the succeeding pass printing, due to the blank portion.

As described above, in the case that the second condition is satisfied, the controller 15 determines the jetting timing such that the target value of the shift amount between the adjacent nozzle groups 24 and 25 is less than the second threshold value (step S6). In this case, the controller 15 determines the jetting timing such that the target value of the shift amount between the adjacent nozzle groups 24 and 25 in the target pass printing becomes 0 (zero). With this, the correction amounts of the jetting timings for the respective nozzle groups 24 and 25 are set to be a same value.

Figure 9A:
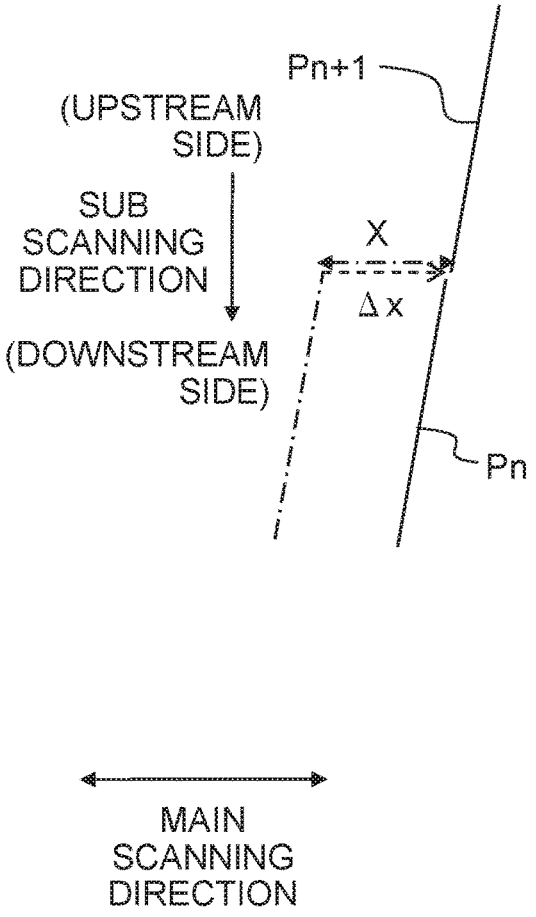
FIG. 9A is a view depicting an example of an image in a case that the jetting timing is determined such that an upstream-side positional shift amount is reduced.

Then, as depicted in FIG. 9A, in a case that the first spacing distance is greater than the first threshold value, and that the second spacing distance is not more than the first threshold value, the controller 15 sets the jetting timing so as to reduce the upstream-side positional shift amount X. Here, the upstream-side positional shift amount X is 70 μm. Accordingly, the displacement amount Δx at the upstream-side position is made to be 70 μm such that a target value X" of the upstream-side positional shift amount becomes 0 (zero). Then, a correcting amount of the jetting timing, corresponding to this displacement amount Δx at the upstream-side position, is obtained as the correction amount of the jetting timing for each of the nozzle groups 24 and 25. Then, the reference jetting timing is corrected by the obtained correction amount so as to determine the jetting timing for each of the nozzle group 24 and the nozzle group 25.

Figure 9B:
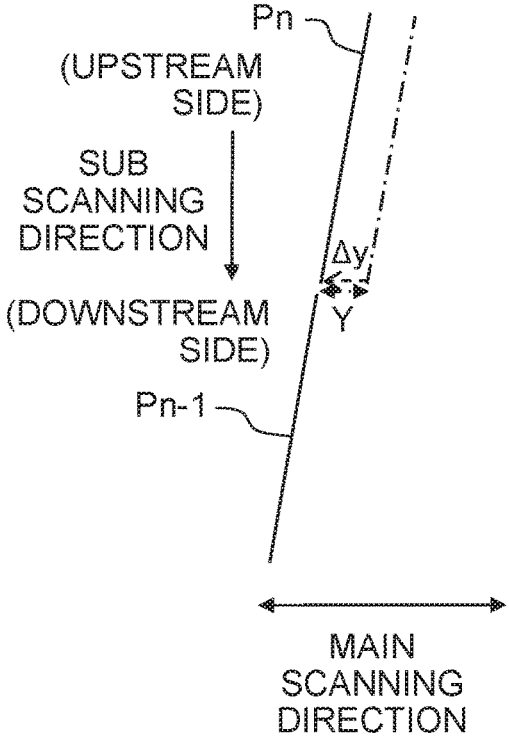
FIG. 9B is a view depicting an example of an image in a case that the jetting timing is determined such that a downstream-side positional shift amount is reduced.

On the other hand, as depicted in FIG. 9B, in a case that the first spacing distance is not more than the first threshold value, and that the second spacing distance is greater than the first threshold value, the controller 15 sets the jetting timing so as to reduce the downstream-side positional shift amount Y. Here, the downstream-side positional shift amount Y is 50 μm. Accordingly, the displacement amount Δy at the downstream-side position is made to be 50 μm such that a target value Y" of the downstream-side positional shift amount becomes 0 (zero). Then, a correcting amount of the jetting timing, corresponding to this displacement amount Δy at the downstream-side position, is obtained as the correction amount of the jetting timing for each of the nozzle groups 24 and 25. Then, the reference jetting timing is corrected by the obtained correction amount so as to determine the jetting timing for each of the nozzle group 24 and the nozzle group 25.

According to this configuration, in the case that the first condition is satisfied, the intended positional shift in the target positions for the liquid droplets is allowed to occur between the nozzle groups in the pass printing. It is possible to reduce the positional shift amount of the target positions of the liquid droplets during the continuous pass printings only to an extent (amount) corresponding to the positional shift amount of the target positions for the liquid droplets between the nozzle groups, thereby making it possible to prevent any lowering in the image quality which would be otherwise caused by a large positional shift.

Further, in the case that the first condition is satisfied, an equally divided value obtained by equally dividing the total positional shift amount by the number obtained by adding 1 (one) to the total number of the nozzle groups is determined as each of the target values Z, X' and Y' of the positional shift amounts of the target positions. With this, since the positional shift amount of the target positions of the liquid droplets to be used during the continuous pass printings and between the adjacent nozzle groups is equally divided, it is possible to prevent any lowering in the image quality which would be otherwise caused by any non-uniform positional shifting.

Furthermore, in the case that the second condition is satisfied, any unnecessarily large positional shift does not occur between the nozzle groups during one pass printing, thus making it possible prevent the lowering in the image quality which would be otherwise caused by such unnecessarily large positional shift.

Moreover, in the case that the second condition is satisfied, the target value Y of the positional shift amount between the adjacent nozzle groups is made to be 0 (zero). By doing so, any unnecessary positional shift of the target positions of the liquid droplets is not allowed to occur between the adjacent nozzle groups, and thus any lowering in the image quality which would be otherwise caused due to any unnecessary positional shifting can be prevented.

Further, in a case that the second condition is satisfied and that the first spacing distance is not more than the first threshold value and that the second spacing distance is greater than the first threshold value, the controller 15 determines the jetting timing as to reduce the downstream-side positional shift amount. With this, the positional shift amount in the main scanning direction between the first target position by the target pass printing and the second target position by the preceding pass printing is reduced, which in turn makes it possible to prevent any lowering in the image quality which would be otherwise caused by any large positional shifting.

Furthermore, in a case that the second condition is satisfied and that the first spacing distance is greater than the first threshold value and that the second spacing distance is not more than the first threshold value, the controller 15 determines the jetting timing as to reduce the upstream-side positional shift amount. With this, the positional shift amount in the main scanning direction between the third target position by the target pass printing and the fourth target position by the succeeding pass printing is reduced, which in turn makes it possible to prevent any lowering in the image quality which would be otherwise caused by any large positional shifting.

Note that in the embodiment, in a case that the liquid droplet jetting apparatus 10 has a configuration capable of performing a high speed printing mode of which preference is printing speed over image quality and a photo printing mode of which preference is image quality of a photo, etc., the high speed printing mode is an example of the predetermined printing mode. In this example, in the photo printing mode, the controller 15 may perform, regardless of the printing data, such a setting that different jetting timings are set for the nozzle groups 23 which are divided into the colors, respectively, wherein a same jetting timing is set for all the nozzles belonging to each of the nozzle groups; or the controller 15 may perform, regardless of the printing data, such a setting that different jetting timings are set for a black nozzle groups and color nozzle groups 23 of which color is different from the black, respectively, wherein a same jetting timing is set for all the nozzles belonging to the black nozzle group and another same jetting timing is set for all the nozzles belonging to the remaining color nozzle groups. Further, regarding the photo printing mode, the controller 15 may perform such a control to execute, between a pass printing in the going-path (forward) direction and a pass printing in the returning-path (reverse) direction, an interlace printing wherein printing is performed without conveying the recording medium 16.

Second Embodiment

In a liquid droplet jetting apparatus 10 according to a second embodiment, the controller 15 determines that the second condition is satisfied in a case that at least one of a first printing data, a second printing data, a third printing data and a fourth printing data is a printing data which does not cause the liquid droplets to be jetted over an entire area in the main scanning direction (namely, a print data in which an amount of the liquid droplets to be jetted over the entire area in the main scanning direction is 0 (zero)).

The first printing data is a printing data which is included in a printing data for the target pass printing and which relates to downstream-most nozzles (downstream-end nozzles) 21 arranged on the most downstream side in the sub scanning direction. The second printing data is a printing data which is included in a printing data for the preceding pass printing and which relates to upstream-most nozzles (upstream-end nozzles) 21 arranged on the most upstream side in the sub scanning direction. The third printing data is a printing data which is included in the printing data for the target pass printing and which relates to upstream-most nozzles (upstream-side nozzles) 21 arranged on the most upstream side in the sub scanning direction. The fourth printing data is a printing data which is included in a printing data used during the succeeding pass printing and which relates to downstream-most nozzles (downstream-end nozzles) 21 included in the plurality of nozzles 21 and arranged on the most downstream side in the sub scanning direction.

A target position (downstream-end target position) Ld of the liquid droplets jetted from the downstream-end nozzles 21 in the target pass printing and a target position (upstream-end target position) Lu of the liquid droplets jetted from the upstream-end nozzles 21 in the preceding pass printing are adjacent to each other in the sub scanning direction. In a case that the first printing data with respect to the downstream-end nozzles 21 and/or the second printing data with respect to the upstream-end nozzles 21 are/is a printing data which does not cause the liquid droplets to be jetted over the entire area in the main scanning direction, any dots are not formed in the downstream-end target position Ld and/or the upstream-end target position Lu, thereby leaving a blank (blank portion) in the downstream-end target position Ld and/or the upstream-end target position Lu. Thus, the first spacing distance between the first target position L1 and the second target position L2 becomes greater than the first threshold value only to the extent corresponding to this blank portion. Similarly, in a case that the third printing data and/or the fourth printing data are/is a printing data which does not cause the liquid droplets to be jetted over the entire area in the main scanning direction, the second spacing distance between the third target position L3 and the fourth target position L4 becomes greater than the first threshold value.

Note that each of the first target position L1 and the fourth target position L4 is a downstream-most target position which is located on the most downstream side in the sub scanning direction among the target positions at which the liquid droplets jetted from the nozzles 21 are made to land in the target pass printing and the succeeding pass printing, and the dots are formed thereby. Accordingly, the downstream-end target position Ld is not necessarily the first target position L1 and the fourth target position L4. For example, in a case that the first printing data with respect to the downstream-end nozzles 21 is the printing data which does not cause the liquid droplets to be jetted, any liquid droplets are not jetted at the downstream-end target position Ld, and thus no dots are formed in the downstream-end target position Ld. Accordingly, a target position of liquid droplets jetted from certain nozzles 21, located on the most downstream side among nozzles 21 to which a printing data causing the liquid droplets to be jetted is given and which are located on the upstream side relative to the downstream-end nozzles 21, becomes the first target position L1 and the fourth target position L4. Further, since the relationship between the upstream-end target position Lu and the second and third target positions L2 and L3 is similar to the relationship between the downstream-end target position Ld and the first and fourth target positions L1 and L4, the explanation therefor will be omitted.

Figure 10A:
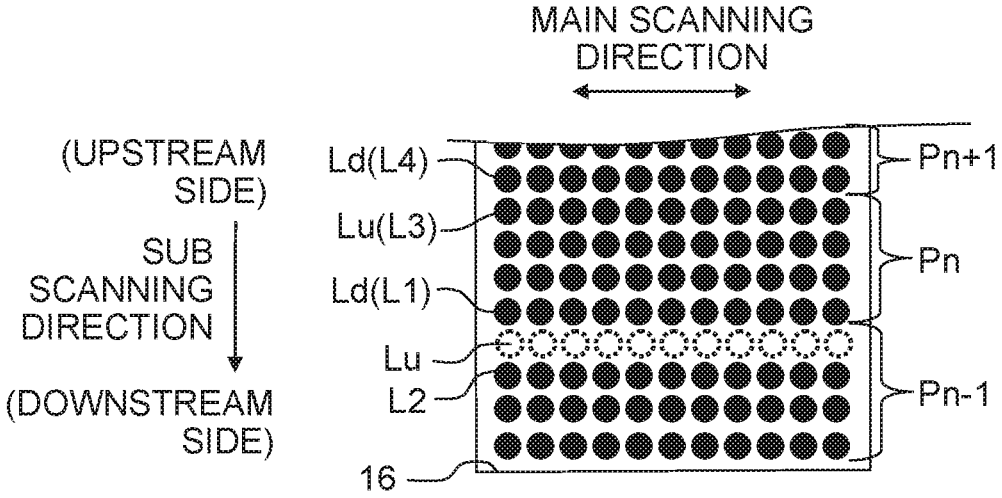
FIG. 10A is a view depicting an example of an image in a case that the spacing distance in the sub scanning direction between predetermined dots and preceding dots is greater than a predetermined spacing distance due to a blank line (linear) area on the downstream end.

In an example depicted in FIG. 10A, the first printing data is not the printing data which does not cause the liquid droplets to be jetted over the entire area in the main scanning direction. In this case, the liquid droplets are jetted from the downstream-end nozzles 21 which are moved in the main scanning direction in the target pass printing, and the dots are formed at the downstream-end target position Ld over the entire area in the main scanning direction. Accordingly, the downstream-end target position Ld becomes the first target position L1.

On the other hand, in a case that the second printing data is the printing data which does not cause the liquid droplets to be jetted over the entire area in the main scanning direction, the liquid droplets are not jetted from the upstream-end nozzles 21 in the preceding pass printing, and the dots are not formed at the upstream-end target position Lu, thereby providing a blank portion at the upstream-end target position Lu. Accordingly, the upstream-end target position Lu does not become the second target position L2; the second target position L2 is provided (set) on the downstream side relative to the downstream-end target position Lu.

As described above, since a blank portion is formed (provided) at the upstream-end target position Lu in such a manner, the first spacing distance between the first target position L1 and the second target position L2 becomes greater than the first threshold value only to the extent corresponding to the blank portion. Further, the above situation is similarly applicable also to the third printing data and the fourth printing data, the explanation therefor will be omitted. Therefore, in a case that at least one of the first printing data, the second printing data, the third printing data and the fourth printing data is the printing data which does not cause the liquid droplets to be jetted over the entire area in the main scanning direction, the controller 15 determines that the second condition is satisfied.

Third Embodiment

In a liquid droplet jetting apparatus 10 according to a third embodiment, the controller 15 determines that the first condition is satisfied in a case that the first printing data and the second printing data both include a printing data for forming dots which are aligned in the sub scanning direction, and that the third printing data and the fourth printing data both include a printing data for forming dots which are aligned in the sub scanning direction.

Specifically, the controller 15 analyzes printing data located at a same location in the main scanning direction, regarding the first printing data and the second printing data.

Figure 10B:
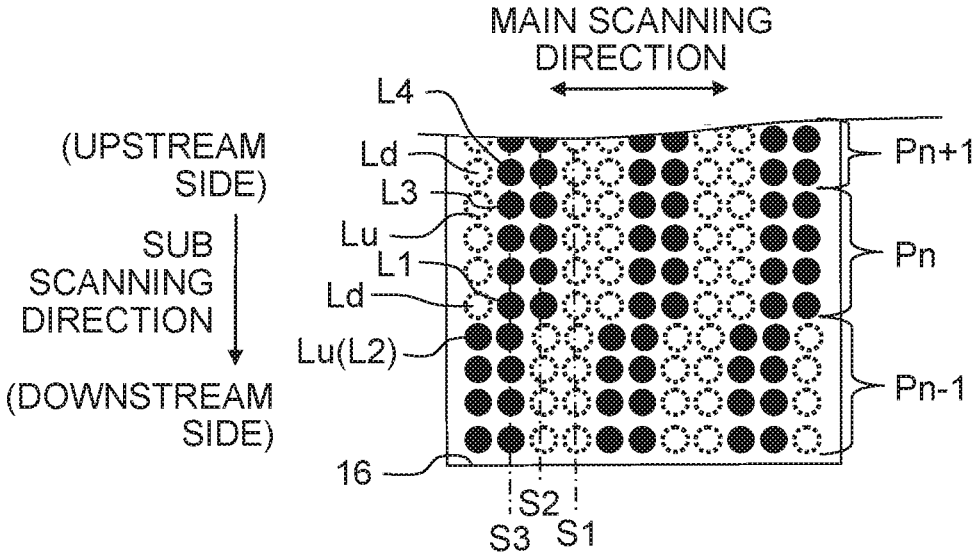
FIG. 10B is a view depicting an example of an image in a case that the spacing distance in the sub scanning direction between predetermined dots on the downstream end and preceding dots is not more than the predetermined spacing distance.

At a position S1 in the main scanning direction as depicted in FIG. 10B, each of the first printing data relating to the downstream-end nozzle 21 in the target pass printing and the second printing data relating to the upstream-end nozzle 21 in the preceding pass printing is a printing data which does not cause the liquid droplet to be jetted. Accordingly, a blank portion is formed at each of the downstream-end target position Ld and the upstream-end target position Lu.

At a position S2 in the main scanning direction, the first printing data is a printing data which causes the liquid droplet to be jetted from the downstream-end nozzle 21, whereas the second printing data is a printing data which does not cause the liquid droplet to be jetted. Accordingly, while the downstream-end target position Ld is coincident with the first target position L1, a blank portion is formed at the upstream-end target position Lu.

At a position S3 in the main scanning direction, each of the first printing data and the second printing data is a printing data which causes the liquid droplet to be jetted from one of the downstream-end nozzle 21 and the upstream-end nozzle 21. Accordingly, the downstream-end target position Ld is coincident with the first target position L1, and the upstream-end target position Lu is coincident with the second target position L2. Therefore, the first spacing distance between the first and second target positions L1 and L2 is not more than the first threshold value.

Regarding the third printing data and the fourth printing data, the controller 15 also analyzes in a similar manner as regarding the first printing data and the second printing data. Further, in the example depicted in FIG. 10B, the second spacing distance between the third and fourth target positions L3 and L4 is not more than the first threshold value at the positions S2 and S3. Accordingly, in a case that the first printing data and the second printing data both include a printing data for forming dots which are aligned in the sub scanning direction, and that the third printing data and the fourth printing data both include the printing data for forming dots which are aligned in the sub scanning direction, the controller 15 can determine that the first condition is satisfied.

Fourth Embodiment

A liquid droplet jetting apparatus 10 according to a fourth embodiment is provided with a waved-shape generation mechanism 30 configured to generate, in the recording medium 16, a predetermined waved shape in which a convex portion (mountain-shaped portion) M a concave portion (valley-shaped portion) V are arranged side-by-side alternately in the main scanning direction. The controller 15 sets the jetting timings of the nozzle groups 24 and 25, respectively, for each of regions, in the recording medium 16, including at least one of the convex portion M and the concave portion V, based on the printing data.

Note that the convex portion M is a portion, of the recording medium 16, which projects toward the jetting head 20 and in which a distance in the up/down direction (normal direction to the nozzle surface 22) between the recording medium 16 and the nozzle surface 22 changes from decrease to increase in the main scanning direction. The concave portion V is a portion, of the recording medium 16, which is recessed in a direction toward an opposite side of (away from) the jetting head 20, and in which the distance in the up/down direction between the recording medium 16 and the nozzle surface 22 changes from increase to decrease in the main scanning direction.

Figure 11A:
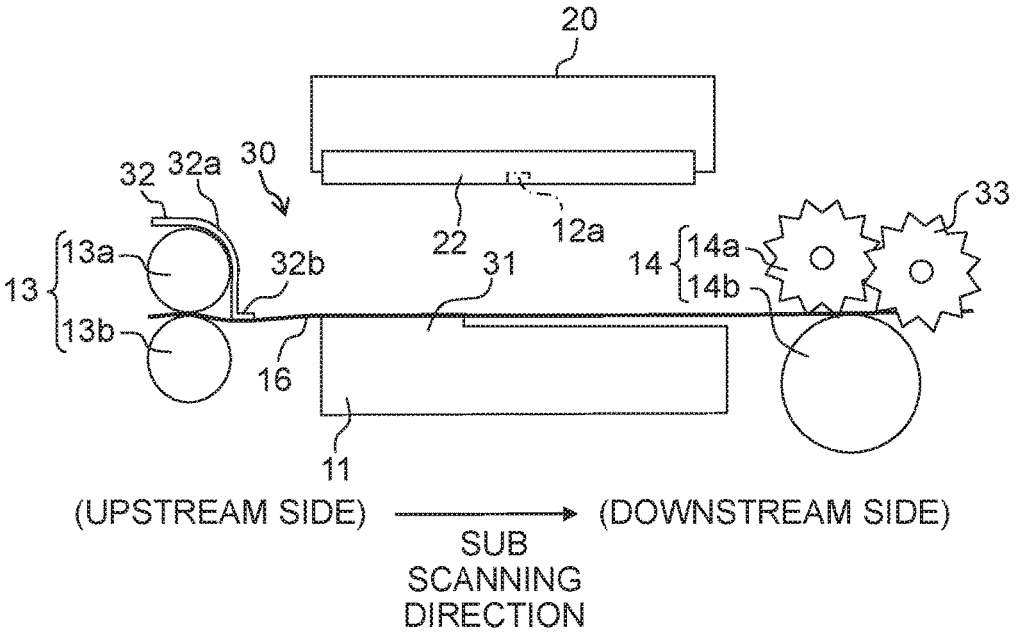
FIG. 11A is a view schematically depicting a waved-shape generation mechanism.

The waved-shape generation mechanism 30 as depicted in FIG. 11A is provided with a plurality of ribs 31, a plurality of corrugating plates 32, and a plurality of corrugating spurs 33. Each of the plurality of ribs 31, the plurality of corrugating plates 32 and the plurality of corrugating spurs 33 are arranged in the main scanning direction.

The ribs 31 are projected upward from the upper surface of the platen 11 and extend in the sub scanning direction. The corrugating plates 32 are locked by a rail (not depicted in the drawings) of the platen 11, at a position above an upper roller 13*a* of an upstream-side conveyance roller 13. A bent portion 32*a* of each of the corrugating plates 32 is bent along, and with a spacing distance from, the outer circumferential surface of the upper roller 13*a*. A pressing portion 32*b* of each of the corrugating plates 32 is flat plate-shaped, and faces (is opposite to) the upper surface of the platen 11, with a spacing distance therebetween. The ribs 31 and the corrugating plates 32 are arranged alternately in the main scanning direction.

A downstream-side conveyance roller 14 is arranged at a position facing the ribs 31 in the main scanning direction, and has an upper roller 14*a* and a lower roller 14*b*. The corrugating spurs 33 are arranged at positions facing the corrugating plates 32, respectively, in the sub scanning direction.

Figure 11B:
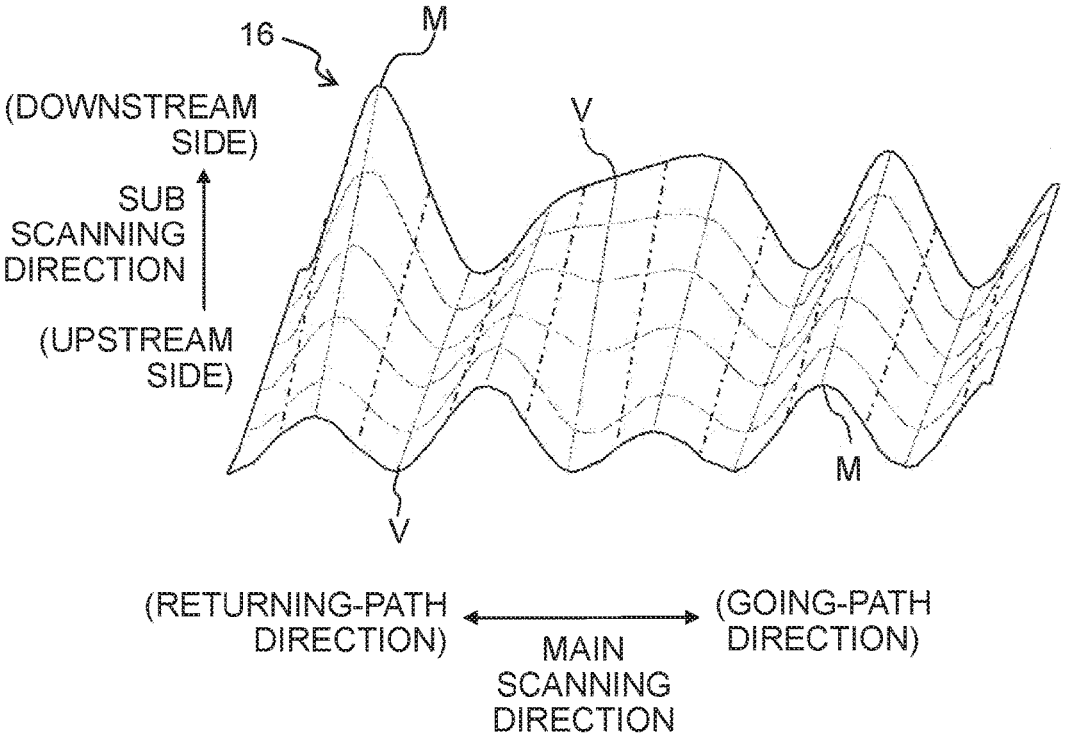
FIG. 11B is a view schematically depicting a recording medium imparted with a waved shape.

On the platen 11, the recording medium 16 is supported by the ribs 31 from therebelow and is pressed by the lower surface of the pressing portion 32*b* of each of the corrugating plates 32 from thereabove. The lower surface of the pressing portion 32*b* is located at a position below the upper edge portion of each of the ribs 31. Accordingly, the convex portions M are formed in the recording medium 16 at portions each of which is supported by one of the ribs 31, and the concave portions V are formed in the recording medium 16 at portions each of which is sandwiched between the pressing portion 32 of one of the corrugating plates 32 and the platen 11. The convex portions M and the concave portions V are arranged alternately in the main scanning direction to thereby form a waved shape. The recording medium 16 imparted with the waved shape as depicted in FIG. 11B is allowed to pass between the platen 11 and the nozzle surface 22. Here, the convex portions M of the recording medium 16 approach closer to the nozzle surface 22 in the up/down direction, and the concave portions V of the recording medium 16 recede from the nozzle surface 22 farther than the convex portions M in the up/down direction. Further, the convex portions M of the recording medium 16 are pinched by the downstream-side roller 14 and the concave portions V of the recording medium 16 are pressed by the corrugating spurs 33 from thereabove, and the recording medium 16 is discharged to a discharge tray (not depicted in the drawings).

There is such a case that, while the recording medium 16 is moving after the waved shape has been imparted to the recording medium 16 by the ribs 31 and the corrugating plates 32 in such a manner and until the recording medium 16 reaches a position at which the recording medium 16 face (is opposite to) the nozzle surface 22, the waved shape is deformed and made different between the upstream side and the downstream side in the recording medium 16. Accordingly, the controller 15 sets, based on the printing data, the jetting timings for the nozzle groups 24 and 25 respectively, for each of the regions, in the recording medium 16, including the convex portions M and the concave portions V respectively. With this, in a case that the convex portions M and the concave portions V are formed in the recording medium 16, the jetting timings of the nozzle groups 24 and 25 respectively can be determined for each of the region including the convex portions M and the region including the concave portions V.

Specifically, an encoder sensor 12*a* (FIG. 11A) mounted on the carriage 12 (FIG. 1) detects slits formed along the main scanning direction in an encoder belt (not depicted in the drawings) which extends in the main scanning direction. The controller 15 (FIG. 1) counts the number of the slits and calculates the position of the jetting head 20 in the main scanning direction, based on the counted number of the slits.

The height of the recording medium 16 imparted with the waved shape changes depending on the positions in the recording medium 16 in the main scanning direction. Therefore, in a case that the liquid droplets are jetted at the reference jetting timing, the landing positions of the liquid droplets which are adjacent in the main scanning direction are not defined at an equal interval. Accordingly, based on a certain position of the jetting head 20 in the main scanning direction obtained based on the counted number of the slits, the controller 15 obtains the height of a portion, of the recording medium 16, which corresponds to the certain position of the jetting head 20. Then, the controller 15 calculates a first correction amount according to the obtained height. The first correction amount is a time (period or duration of time) during which the jetting timing is to be corrected such that the spacing distance between the landing positions of liquid droplets which are adjacent in the main scanning direction are constant in the recording medium 16 imparted with the waved shape. The first correction amount is, for example, set to be 0 (zero) at the concave portion V in which the height is the lowest, and is set to be longer as the height from the concave portion V becomes greater.

Further, the controller 15 sets, based on the printing data, a second correction amount of the jetting timings of the nozzle groups 24 and 25 respectively, for each of the regions, in the recording medium 16, including the convex portions M and the concave portions V respectively. The second correction amount is a time (period or duration of time) during which the jetting timing is to be corrected for each of the nozzle groups 24 and 25 based on the upstream-side positional shift amount and a downstream-side positional shift amount.

Here, in a case that the first condition is satisfied, the controller 15 sets, for example, the second correction amount to be different values, respectively, for the adjacent nozzle groups 24 and 25 such that the target value Z of the positional shift amount between the adjacent nozzle groups 24 and 25, the target value X' of the upstream-side positional shift amount, and the target value Y' of the downstream-side positional shift amount are equally divided. Alternatively, in a case that the second condition is satisfied, the controller 15 sets, for example, the second correction amount to be a same value for the adjacent nozzle groups 24 and 25 in order that the target value X" of the upstream-side positional shift amount or the target value Y" of the downstream-side positional shift amount becomes 0 (zero). Further alternatively, in a case that the upstream-side positional shift amount and the downstream-side positional shift amount are greater than a predetermined amount, the second correction amount is 0 (zero), and the controller 15 sets the second correction amount to be a same value for the adjacent nozzle groups 24 and 25.

Further, the controller 15 determines the jetting timing by advancing (quickening) or delaying the reference jetting timing by a correction amount (correction time) to which the first correction amount and the second correction amount are added.

In such a manner, since the jetting timing is adjusted by the first correction amount corresponding to the height of the recording medium 16 having the waved shape and by the second correction amount corresponding to the spacing distances in the sub scanning direction between the predetermined and preceding dots and between the predetermined and succeeding dots, the liquid droplets can be landed on appropriate positions in the recording medium 16.

Note that in the above-described embodiment, the region of the recording medium 16 is set by using regions each including one of the convex portion M and the concave portion V. The method for setting the regions, however, is not limited to this. For example, it is allowable to set the region of the recording medium 16 by using regions each including the convex portion M and the concave portion V.

Note that in the above-described embodiment, the waved-shape generation mechanism 30 includes a plurality of ribs 31, a plurality of corrugating plates 32, and a plurality of corrugating spurs 33, and each of the plurality of ribs 31, the plurality of corrugating plates 32 and the plurality of corrugating spurs 33 are arranged in the main scanning direction. The waved-shape generation mechanism, however, is not limited to this. The waved-shape generation mechanism may be composed of a single rib, two corrugating plates arranged on both sides of the single rib in the main scanning direction, and two corrugating spurs arranged at positions facing the two corrugating plates, respectively, in the sub scanning direction. Alternatively, the waved-shape generation mechanism may be composed of a single corrugating plate, two ribs arranged on both sides of the single corrugating rib in the main scanning direction, and a single corrugating spur arranged at a position facing the single corrugating plate in the sub scanning direction.

Note that in all the embodiments described above, the two conveyance rollers 13 and 14 are used as the conveying section (conveyer). The conveying section, however, is not limited to this. For example, two pulleys and an endless adsorption belt, which is wound around the pulleys and which adsorbs the recording medium 16 to be conveyed in the sub scanning direction, may be used as the conveying sections. Alternately, two sprockets and an endless belt, which has a plurality of engaging holes to be engaged with teeth of the sprockets and which goes around the sprockets, may be used as the conveying section.

Note that in all the embodiments described above, the jetting timing is determined, in the jetting timing determining process, by correcting the reference jetting timing. The present teaching, however, is not limited to such a correcting method as described above.

The liquid droplet jetting apparatus of the present teaching is useful as a liquid droplet jetting apparatus capable of reducing any lowering in image quality.

What is claimed is:

1. A liquid droplet jetting apparatus comprising:

a jetting head having a nozzle surface on which nozzles are aligned in a first direction, the jetting head configured to jet liquid droplets from the nozzles, the nozzles forming nozzle groups including two nozzle groups which are adjacent in the first direction;

a conveyer configured to convey a recording medium in the first direction; and a controller; and a memory storing computer readable instructions that, when executed, cause the controller to:

receive a printing data from an image scanner or an external device;

determine a jetting timing for each of the nozzle groups based on the printing data; and execute a target printing to form a first image along the first direction in a first area on the recording medium, when the jetting head is at a first position in a second direction relative to the recording medium, the second direction being along the nozzle surface an intersecting the first direction;

execute a preceding printing to form a second image along the first direction in a second area on the recording medium when the jetting head is at a second position in the second direction relative to the recording medium, the preceding printing performed immediately before the target printing, the second image being formed before the first image on the recording medium, the second area being in the same position as the first area of the recording medium in the second direction; and execute a succeeding printing to form a third image along the first direction in a third area on the recording medium when the jetting head is at a third position in the second direction relative to the recording medium, the succeeding printing performed immediately after the target printing, the third image being formed after the first image on the recording medium, the third area being in the same position as the first area and the second area of the recording medium in the second direction;

wherein in a case of determining the jetting timing, the controller is configured to:

determine a first spacing distance and a second spacing distance based on the printing data, the first spacing distance being a distance between a first target position located on the closest side to the second area of the recording medium in the first direction among landing target positions of the liquid droplets in the target printing and a second target position located on the closest side to the first area of the recording medium in the first direction among landing target positions of the liquid droplets in the preceding printing, the second spacing distance being a distance between a third target position located on the closest side to the third area of the recording medium in the first direction among the landing target positions of the liquid droplets in the target printing and a fourth target position located on the closest side to the first area of the recording medium in the first direction among landing target positions of the liquid droplets in the succeeding printing;

in a case that both the first spacing distance and the second spacing distance are not more than a first threshold value, determine that a first condition is satisfied;

in a case that at least one of the first spacing distance and the second spacing distance is greater than the first threshold value, determine that a second condition is satisfied;

in a case that the first condition is satisfied, determine the jetting timing such that a target value of a shift amount in the second direction, between landing target positions of liquid droplets jetted from one nozzle group of the two nozzle groups and landing target positions of liquid droplets jetted from the other nozzle group of the two nozzle groups, is not less than a second threshold value; and in a case that the second condition is satisfied, determine the jetting timing such that the target value of the shift amount is less than the second threshold value.

2. The liquid droplet jetting apparatus according to claim 1, further comprising a movement mechanism configured to move one of the jetting head and the recording medium, thereby changing a position of the jetting head and the recording medium from the second position to the first position, and changing the position of the jetting head and the recording medium from the first position to the third position.

3. The liquid droplet jetting apparatus according to claim 2, wherein the movement mechanism includes a carriage mounting the jetting head, the carriage configured to reciprocate in the second direction, wherein the controller is configured to:

control the jetting head and the carriage to print in the first area using the nozzle groups in a same single pass of the jetting head;

control the jetting head and the carriage to print in the second area using the nozzle groups in a same single pass of the jetting head; and control the jetting head and the carriage to print in the third area using the nozzle groups in a same single pass of the jetting head.

4. The liquid droplet jetting apparatus according to claim 1, wherein in a case of determining the jetting timing, the controller is configured to:

determine a first distance value and a second distance value based on the printing data, the first distance value being a value regarding a distance by which the recording medium is conveyed in the first direction after the preceding printing and before the target printing, the second distance value being a value regarding a distance by which the recording medium is conveyed in the first direction after the target printing and before the succeeding printing;

determine that the first condition is satisfied, in a case that the first and second distance values are less than a third threshold value; and determine that the second condition is satisfied, in a case that at least one of the first and second distance values is greater than the third threshold value.

5. The liquid droplet jetting apparatus according to claim 1, wherein in a case of determining the jetting timing, the controller is configured to:

analyze a first printing data which is included in a printing data for the target printing and which is for a downstream-end nozzle included in the nozzles and located on the most downstream side in the first direction, a second printing data which is included in a printing data for the preceding printing and which is for an upstream-end nozzle included in the nozzles and located on the most upstream side in the first direction, a third printing data which is included in the printing data for the target printing and which is for the upstream-end nozzle, and a fourth printing data which is included in a printing data for the succeeding printing and which is for the downstream-end nozzle; and determine that the second condition is satisfied, in a case that no liquid droplet is jetted from at least one of the downstream-end nozzle and the upstream-end nozzle over an entire area of the recording medium in the second direction based on at least one of the first printing data, the second printing data, the third printing data and the fourth printing data.

6. The liquid droplet jetting apparatus according to claim 1, wherein in a case of determining the jetting timing, the controller is configured to:

analyze a first printing data which is included in a printing data for the target printing and which is for a downstream-end nozzle included in the nozzles and located on the most downstream side in the first direction, a second printing data which is included in a printing data for the preceding printing and which is for an upstream-end nozzle included in the nozzles and located on the most upstream side in the first direction, a third printing data which is included in the printing data for the target printing and which is for the upstream-end nozzle, and a fourth printing data which is included in a printing data for the succeeding printing and which is for the downstream-end nozzle; and determine that the first condition is satisfied, in a case that the first printing data and the second printing data both include a printing data for forming dots which are aligned in the first direction, and that the third printing data and the fourth printing data both include a printing data forming dots which are aligned in the first direction.

7. The liquid droplet jetting apparatus according to claim 1, wherein in a case that the first condition is satisfied, the controller is configured to:

calculate a downstream-side positional shift amount which is a shift amount in the second direction between the first and second target positions and an upstream-side positional shift amount which is a shift amount in the second direction between the third and fourth target positions, based on a printing data in each of the target printing, the preceding printing and the succeeding printing, calculate an equally divided value by equally dividing a total positional shift amount, which is a sum of the downstream-side positional shift amount and the upstream-side positional shift amount, by a number obtained by adding 1 to a total number of the nozzle groups; and determine the jetting timing such that each of the target value of the shift amount in the target printing, a target value of the downstream-side positional shift amount, and a target value of the upstream-side positional shift amount is the equally divided value.

8. The liquid droplet jetting apparatus according to claim 1, wherein in a case that the second condition is satisfied, the controller is configured to determine the jetting timing such that the target value of the shift amount in the target printing is 0.

9. The liquid droplet jetting apparatus according to claim 1, wherein in a case that the second condition is satisfied, the controller is configured to:

determine the jetting timing so as to reduce a downstream-side positional shift amount which is a shift amount in the second direction between the first and second target positions, in a case that the first spacing distance is not more than the first threshold value and the second spacing distance is greater than the first threshold value, and determine the jetting timing so as to reduce an upstream-side positional shift amount which is a shift amount in the second direction between the third and fourth target positions, in a case that the first spacing distance is greater than the first threshold value and the second spacing distance is not more than the first threshold value.

10. The liquid droplet jetting apparatus according to claim 1, further comprising a waved-shape generator configured to generate, in the recording medium, a predetermined waved shape in which a convex portion projecting toward the jetting head and a concave portion recessed in a direction away from the jetting head are arranged side-by-side in the second direction, wherein the controller is configured to determine the jetting timing for each of regions in the recording medium, each of the regions including at least one of the convex and concave portions.

* * * * *